US009427033B2

(12) United States Patent
Blakely et al.

(10) Patent No.: US 9,427,033 B2
(45) Date of Patent: Aug. 30, 2016

(54) ATHLETIC ARM WARMER

(75) Inventors: Kyle Sanders Blakely, Baltimore, MD (US); Jeffrey Allen Dorton, Bel Air, MD (US)

(73) Assignee: Under Armour, Inc., Baltimore, MD (US)

( * ) Notice: Subject to any disclaimer, the term of this patent is extended or adjusted under 35 U.S.C. 154(b) by 926 days.

(21) Appl. No.: 13/400,293

(22) Filed: Feb. 20, 2012

(65) Prior Publication Data

US 2012/0210488 A1 Aug. 23, 2012

Related U.S. Application Data

(63) Continuation-in-part of application No. 12/970,767, filed on Dec. 16, 2010, now Pat. No. 8,667,613.

(60) Provisional application No. 61/287,176, filed on Dec. 16, 2009.

(51) Int. Cl.
*A41D 13/00* (2006.01)
*A41D 13/08* (2006.01)

(52) U.S. Cl.
CPC ..... *A41D 13/08* (2013.01)

(58) Field of Classification Search
CPC A41F 17/00; A41D 13/00568; A41D 27/20; A41D 13/0015
USPC ..... 2/273, 102, 69, 16, 159
See application file for complete search history.

(56) References Cited

U.S. PATENT DOCUMENTS

| | | | | | |
|---|---|---|---|---|---|
| 731,791 | A | | 6/1903 | Krifka | |
| 1,117,077 | A | | 11/1914 | Mooney | |
| 1,285,917 | A | | 11/1918 | Bradley | |
| 1,365,731 | A | * | 1/1921 | Schloss | 2/273 |
| 1,388,802 | A | * | 8/1921 | Cooper | 2/273 |
| 1,645,946 | A | | 10/1927 | Currea | |
| 1,708,144 | A | | 4/1929 | Martin | |
| 1,796,782 | A | | 3/1931 | Gasperini | |
| 1,828,678 | A | * | 10/1931 | Peterman et al. | 160/349.1 |
| 1,833,109 | A | | 11/1931 | Day | |
| 1,936,198 | A | * | 11/1933 | Kirsch | 160/349.1 |
| 1,973,419 | A | | 9/1934 | Trageser | |
| 2,045,157 | A | | 6/1936 | Mathias | |
| 2,319,292 | A | * | 5/1943 | Boggs | 2/96 |
| 2,339,409 | A | | 1/1944 | Milton et al. | |
| 2,459,992 | A | | 1/1949 | Cimino | |
| 2,494,987 | A | | 1/1950 | Chaitin | |
| 2,700,769 | A | | 2/1955 | Polchinski | |
| 2,715,226 | A | | 8/1955 | Weiner | |
| 3,000,378 | A | | 9/1961 | Zieman | |
| 3,024,466 | A | | 3/1962 | Agostini | |
| 3,329,144 | A | | 7/1967 | Liman | |
| 3,433,221 | A | | 3/1969 | Kendall et al. | |
| 3,889,297 | A | * | 6/1975 | Jarboe et al. | 2/16 |
| 4,142,570 | A | * | 3/1979 | Heimberg | 160/349.1 |
| 4,229,833 | A | * | 10/1980 | Cox et al. | 2/16 |

(Continued)

*Primary Examiner* — Richale Quinn
(74) *Attorney, Agent, or Firm* — Maginot, Moore & Beck LLP

(57) ABSTRACT

A device for warming a first arm and shoulder of a wearer includes a single arm portion and a torso portion. The single arm portion is comprised of a substantially flexible material and is configured to substantially cover the first arm of the wearer from the shoulder to a position beyond an elbow of the first arm. The torso portion is connected to the single arm portion and includes at least one pocket. At least one weight is retained in the pocket of the torso portion.

15 Claims, 17 Drawing Sheets

(56) References Cited

U.S. PATENT DOCUMENTS

| | | | | | |
|---|---|---|---|---|---|
| 4,356,570 | A | * | 11/1982 | Vernon et al. | 2/16 |
| 4,394,012 | A | * | 7/1983 | Egbert et al. | 482/105 |
| 4,407,497 | A | * | 10/1983 | Gracie | 482/105 |
| 4,425,667 | A | | 1/1984 | Harrison | |
| 4,569,087 | A | | 2/1986 | Kerwin | |
| 4,590,622 | A | | 5/1986 | Wolfe et al. | |
| D286,341 | S | | 10/1986 | Manzano | |
| 4,773,100 | A | * | 9/1988 | Kuo | 2/46 |
| 4,784,128 | A | | 11/1988 | Scheuermann | |
| 4,951,317 | A | * | 8/1990 | Gray et al. | 2/16 |
| 4,985,934 | A | * | 1/1991 | Perry | 2/125 |
| 4,986,266 | A | | 1/1991 | Lindeman | |
| 5,035,001 | A | | 7/1991 | Novick | |
| 5,105,478 | A | | 4/1992 | Pyc | |
| 5,181,906 | A | | 1/1993 | Bauerfeind | |
| 5,201,075 | A | * | 4/1993 | Svetich | 2/108 |
| 5,290,218 | A | | 3/1994 | Kilbey | |
| 5,325,537 | A | | 7/1994 | Marion | |
| 5,357,633 | A | * | 10/1994 | Rael | 2/16 |
| 5,403,268 | A | | 4/1995 | Clement | |
| D359,835 | S | * | 7/1995 | Hadfield | D2/610 |
| 5,609,569 | A | | 3/1997 | Offenhartz | |
| 5,638,546 | A | * | 6/1997 | Vita | 2/16 |
| 5,642,525 | A | | 7/1997 | Ketola | |
| D394,536 | S | | 5/1998 | Mittelstaedt et al. | |
| 5,909,801 | A | * | 6/1999 | Coffman | 2/16 |
| 5,974,586 | A | * | 11/1999 | Reinoso | 2/16 |
| 6,038,701 | A | | 3/2000 | Regan | |
| 6,052,824 | A | * | 4/2000 | May | 2/16 |
| 6,053,014 | A | | 4/2000 | Cooper | |
| 6,105,163 | A | | 8/2000 | Edmiston | |
| 6,119,270 | A | | 9/2000 | Chou | |
| 6,223,565 | B1 | * | 5/2001 | Cooper | 66/172 E |
| 6,237,151 | B1 | | 5/2001 | Dellinger | |
| 6,298,485 | B1 | | 10/2001 | Heller | |
| 6,464,656 | B1 | | 10/2002 | Salvucci et al. | |
| 6,574,799 | B2 | | 6/2003 | Donaldson | |
| 6,598,235 | B2 | | 7/2003 | Bulla | |
| 6,654,963 | B2 | | 12/2003 | Fayle et al. | |
| D491,713 | S | | 6/2004 | Wilson, II | |
| 6,813,779 | B1 | | 11/2004 | Williams | |
| 6,826,779 | B1 | | 12/2004 | McKenzie | |
| 6,854,130 | B2 | | 2/2005 | Van Der Sleeson | |
| 6,986,164 | B1 | | 1/2006 | Morales | |
| D526,463 | S | | 8/2006 | Deion | |
| 7,284,282 | B2 | | 10/2007 | Bay | |
| 7,376,979 | B2 | * | 5/2008 | Nilsen | 2/69 |
| 7,578,004 | B2 | | 8/2009 | Loyens et al. | |
| 7,841,997 | B1 | | 11/2010 | Heller | |
| 7,900,277 | B1 | * | 3/2011 | O'Brien et al. | 2/273 |
| 8,024,819 | B2 | * | 9/2011 | Gearhart | 2/238 |
| 8,245,322 | B1 | * | 8/2012 | Bouza | 2/102 |
| 8,393,015 | B2 | * | 3/2013 | Jones | 2/273 |
| 8,667,613 | B2 | * | 3/2014 | Blakely et al. | 2/16 |
| 2003/0013368 | A1 | | 1/2003 | Braun | |
| 2004/0158910 | A1 | | 8/2004 | Bay | |
| 2004/0163154 | A1 | * | 8/2004 | Cooper | 2/69 |
| 2004/0193086 | A1 | | 9/2004 | Cofre | |
| 2006/0277653 | A1 | | 12/2006 | Okajima | |
| 2007/0043313 | A1 | | 2/2007 | Avon | |
| 2007/0118950 | A1 | * | 5/2007 | Hogge | 2/69 |
| 2009/0000002 | A1 | * | 1/2009 | Hadash | 2/16 |
| 2009/0178174 | A1 | | 7/2009 | Cash | |

* cited by examiner

ATHLETIC ARM WARMER

CROSS-REFERENCE TO RELATED APPLICATIONS

This application is a continuation-in-part of U.S. patent application Ser. No. 12/970,767, filed Dec. 16, 2010, which claims priority from U.S. Provisional Patent Application No. 61/287,176, filed Dec. 16, 2009.

FIELD

The embodiments disclosed herein relate to the field of athletics and particularly to devices for warming the throwing arm of an athlete.

BACKGROUND

Athletes participating in throwing activities often cover their throwing arms during rest periods or warm-up periods in an attempt to keep their throwing arms warm. An example of this is a baseball pitcher who comes out of a game between innings. In this situation, the pitcher often puts on a full-size quilted winter jacket in an attempt to keep his throwing arm and shoulder warm while the pitcher's team bats. However, because baseball is primarily played in the summer, it is often very hot and most pitchers will only place one arm in the jacket. The remainder of the jacket falls to the ground where it is subject to damage from cleats, dirt, and other ground level dugout assaults. If the pitcher does prevent the jacket from falling to the ground in some way, the remainder of the jacket will tend to cover his body and cause him to sweat. Sweat has an adverse effect on gripping a baseball, and is undesirable for the pitcher. Therefore, a full winter jacket used by a baseball player to simply keep one arm and shoulder warm is inefficient and awkward.

In addition to keeping a single arm warm during sedentary periods, the athlete may also wish to keep the single arm warm during warm-up and other activities. However, draping a full winter jacket over a single arm is very inefficient and clumsy for warm-up, so athletes often completely forego any additional warming garment during warm-up activities. The result is that the throwing arm may cool more than desired during such light warm-up activities.

In view of the foregoing, it would be desirable to provide a device capable of warming a single arm of an athlete without also warming other parts of the body. It would also be advantageous if the device could be used to keep a single arm and shoulder warm without the awkwardness of a full jacket. Furthermore, it would be advantageous if such device were durable and capable of withstanding dugout and sideline conditions during sporting events. Moreover, it would be advantageous if such device could be quickly and easily donned and removed by the athlete.

SUMMARY

A device for warming a first arm and shoulder of a wearer includes a single arm portion and a torso portion. The single arm portion is comprised of a substantially flexible material and is configured to substantially cover the first arm of the wearer from the shoulder to a position beyond an elbow of the first arm. The torso portion is connected to the single arm portion and includes at least one pocket. At least one weight is retained in the pocket of the torso portion.

In at least one embodiment, a garment is provided for warming a first arm and shoulder of a wearer. The garment comprises a sleeve, a torso portion, and at least one weight. The sleeve is configured to receive the first arm of the wearer and substantially cover the first arm of the wearer. The sleeve is the only sleeve on the garment, as the garment does not include an opposing sleeve configured to receive a second arm of the wearer. The torso portion is connected to the sleeve. The torso portion includes a shoulder portion and a chest portion. The shoulder portion is configured to at least partially cover the shoulder of the wearer when the first arm of the wearer is received by the sleeve. The at least one weight is retained on the torso portion and is arranged on the garment to urge the chest portion to remain engaged with a torso of the wearer when the first arm of the wearer is received by the sleeve.

In at least one embodiment, a garment for warming a first arm and shoulder of a wearer comprises a single arm portion and a hand covering. The single arm portion is configured to substantially cover the first arm of the wearer. The single arm portion includes a shoulder end and a wrist end, and the hand covering is moveably coupled to the wrist end of the single arm portion. The hand covering is moveable on the single arm portion between (i) a retracted position wherein the hand covering engages the single arm portion, and (ii) an extended position wherein the hand covering extends past the wrist end of the single arm portion.

The above described features and advantages, as well as others, will become more readily apparent to those of ordinary skill in the art by reference to the following detailed description and accompanying drawings. While it would be desirable to provide an apparatus that provides one or more of these or other advantageous features as may be apparent to those reviewing this disclosure, the teachings disclosed herein extend to those embodiments which fall within the scope of any appended claims, regardless of whether they include or accomplish one or more of the advantages or features mentioned herein.

DESCRIPTION

Figure 2:
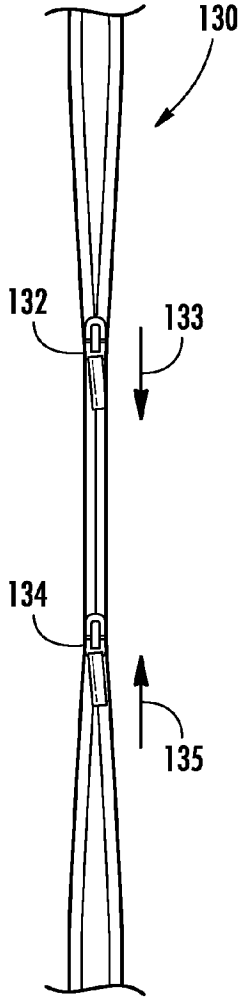
FIG. 2 shows a zipper arrangement provided on a sleeve of the arm warmer of FIG. 1.

With reference now to FIGS. 1-4, in at least one embodiment, an arm warmer 110 includes an arm portion 120 and a torso portion 150. The arm portion 120 is designed to cover an athlete's throwing arm and shoulder while only covering a small amount of the remainder of the athlete's body. This allows the arm warmer 110 to keep the athlete's throwing arm and shoulder warm, while allowing other portions of the athlete's body to remain cool. In various embodiments disclosed herein, the arm portion 120 is shown as a single arm configured to cover the right arm of the wearer, however, it will be recognized that the embodiments of the arm warmer 110 may be symmetric in design such that the single arm 120 when shown as covering the right arm of the wearer could also be provided as a single arm covering the left arm of the wearer (i.e., alternative embodiments will be illustrated by flipping the components shown in a given figure from the right side to the left side of the wearer's body, and vice-versa).

The single arm 120 is generally comprised of a fabric material that is capable of retaining heat and providing a warming effect to the athlete's arm and shoulder. Accordingly, the single arm 120 may be generally comprised of a knit, woven, or non-woven construction, or a combination of such constructions. Furthermore, the single arm 120 may be comprised of any of various materials, such as polyester, cotton, elastane, or other material or combination thereof. In at least one embodiment, the single arm 120 may include a two-layer construction where two different fabrics are combined to provide the desired effect. In such a two-layer construction, an inner layer closest to the skin may be used to wick moisture away from the skin and/or provide compression to the wearer's arm. An outer layer may be used to provide warmth to the wearer's arm.

The single arm 120 provides a sleeve 122 that covers the wearer's throwing arm. The sleeve 122 includes a wrist end 124 and a shoulder end 140. The shoulder end 140 of the sleeve 122 is connected to a shoulder portion 142 along a seam. The wrist end 124 may includes a cuff arrangement, including an interior cuff 126 and an exterior cuff 128. The exterior cuff 128 generally extends over and covers the interior cuff 126 at the end 124 of the sleeve 122.

The exterior cuff 128 is adjustable such that the circumference of the cuff may be changed based on the size of the user's wrist. Accordingly, the exterior cuff 128 may include a flap configured to move relative to a pad on the cuff and change the circumference of the exterior cuff 128. For example, the flap may include a hook portion of a hook-and-loop arrangement, and the pad may include the loop portion. Such an arrangement allows the user repeatedly change the position of the flap relative to the pad and therefore adjust the circumference of the outer cuff. This allows the user to tightly wrap the exterior cuff 128 around the wrist in order to trap heat within the sleeve 122.

Alternatively or in addition to the heat trapping qualities of the exterior cuff 128, the interior cuff 126 may also be configured to prevent heat from escaping the sleeve 122 at the end of the arm 120. In the embodiment of FIGS. 1-4, the interior cuff 126 is generally comprised of an elastic material that expands to allow the wearer's hand to pass through and contracts to hold closely to the wearer's wrist. Accordingly, the elastic interior cuff 126 acts to retain heat within the sleeve by closing around the wrist of the wearer and preventing heat from escaping at the end of the sleeve 122. Although the cuff arrangement of FIGS. 1-4 has been described herein as including both an interior cuff 126 and an exterior cuff 128, it will be recognized that only a single cuff may be provided in various other embodiments of the arm warmer 110.

In the embodiment of FIGS. 1-4, the sleeve 122 includes a zipper arrangement 130 that extends along the substantial length of the sleeve from the shoulder end 140 to the wrist end 124. As best shown in FIG. 2, the zipper arrangement 130 includes an upper zipper pull 132 and a lower zipper pull 134. When the upper zipper pull 132 is moved downward (i.e., in the direction of arrow 133), the teeth of the zipper arrangement 130 are disengaged (i.e., unzipped), opening the portion of the zipper arrangement 130 above the pull 132 and exposing an interior portion of the sleeve 122. Similarly, when the lower zipper pull 134 is moved upward (i.e., in the direction of arrow 135), the teeth of the zipper arrangement are disengaged (i.e., unzipped), opening the portion of the zipper arrangement 130 below the pull 134, and exposing an interior portion of the sleeve 122. This provides an adjustable ventilation arrangement on the sleeve 122, allowing the user to create one or two openings of a desired size in the sleeve based on positioning of the upper zipper pull 132 and lower zipper pull 134. In at least one embodiment, nothing on the inside of the sleeve 122 behind the zipper arrangement 130, such that the open zipper arrangement 130 creates a hole in the sleeve that provides direct access to the arm of the wearer. However, in other embodiments, a lightweight breathable fabric may be positioned on the inside of the sleeve 122 behind the zipper arrangement 130. The lightweight breathable fabric may be, for example, a lightweight polyester material or a mesh material that allows for significant airflow through the material. In other embodiments, the zipper arrangement 130 may be configured to provide for adjustable compression on the sleeve 122. Such an adjustable compression zipper arrangement is explained in further detail below with respect to the embodiment of FIGS. 5-8.

With continued reference now to FIGS. 1-4, a thumb grip 129 is provided on the wrist end 124 of the sleeve 122 on the opposite side of the sleeve 122 from the zipper arrangement 130. The thumb grip 129 is provided as a cylindrical fabric portion on the outer cuff 128 that is configured to receive the thumb of the wearer and assist the wearer in removing or donning the warmer device 110. In particular, the user may insert the thumb or other finger from the opposite hand of the user into the thumb grip 129 when the user removes his or her arm from the sleeve 122 to prevent the sleeve from turning inside-out. This thumb grip 129 is especially useful if a compression material such as elastane is used as a fabric for the sleeve 122. The perimeter of the thumb grip 129 may include a durable, relatively rigid or hard material, such as a plastic rim or a perimeter of reinforced stitching that provides a ring structure for the user to grab with his or her thumb.

Figure 1:
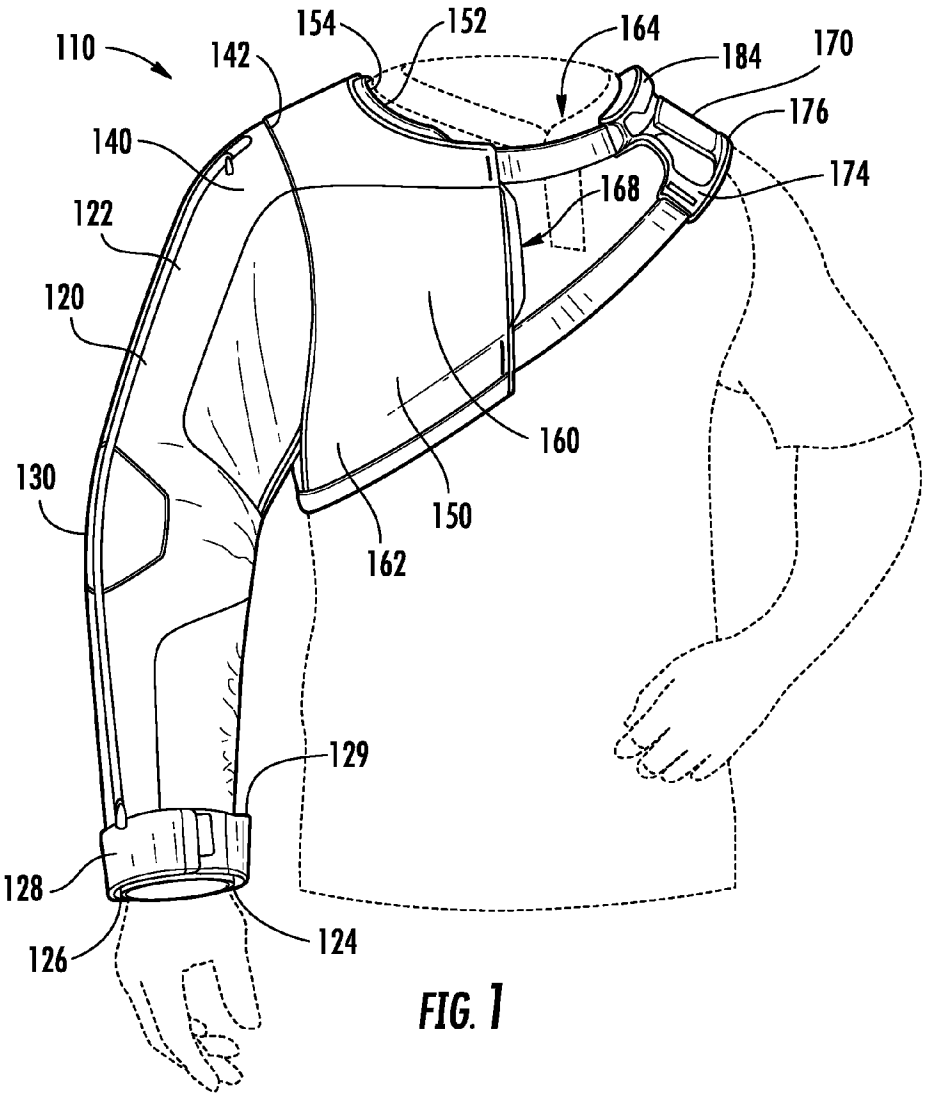
FIG. 1 shows a front view of an embodiment of an arm warmer for an athlete.

The torso portion 150 of the arm warmer 110 is connected to the arm portion 120 along a seam along an edge of the shoulder portion 142. The torso portion 150 includes the shoulder portion 142, a chest portion 160, and a shoulder harness 170, with a neck opening 164 defined by the shoulder portion 142, chest portion 160 and the shoulder harness 170. Although the arm warmer may include the seam between the arm portion 120 and the torso portion 150, as shown in FIG. 1, it will be recognized that in other embodiments, the arm portion 120 and the torso portion 150 may be integrally formed such that no seam or other distinct coupling is provided at transition from the arm portion 120 to the torso portion 150.

A partial collar 152 provided along an upper edge of the chest portion 160 and the shoulder portion 142. The partial collar 152 extends about half way around one side of the user's neck. Together, the partial collar 152 and the shoulder harness 170 define the neck opening 164 for the arm warmer 110. A shoulder pad 154 is positioned on the inside of the shoulder portion 142 and chest portion 160 and extends from the partial collar 152 toward the shoulder end 140 of the sleeve 122. The shoulder pad 154 is comprised of a grippy material that provides a surface with a relatively high coefficient of friction. The grippy material may be, for example, plastisol, such as a tackifying ink comprised of PVC (polyvinyl chloride). Alternatively, the grippy material may be any of various other materials that will provide a surface with a high coefficient of friction, as will be recognized by those of skill in the art. Accordingly, the shoulder pad 154 provides a grip member on an interior of the shoulder portion 142 (and/or chest portion) of the arm warmer 110 that is configured to contact the shirt of a user and prevent slippage of the torso portion 150 on the user. Although not shown in FIG. 1, a webbing handle may also be provided on the inside of the arm warmer 110 near the shoulder portion 142. The webbing handle may facilitate hanging or carrying of the device by the user.

The shoulder portion 142 of the torso portion 150 is configured to cover a substantial portion of the user's shoulder. The chest portion 160 is coupled to the shoulder portion 142 and extends downward from the partial collar 152. The chest portion 160 is configured to substantially cover the pectoral muscle on the right side of the user without covering the opposite left shoulder and left pectoral muscle of the user. While the shoulder portion 142 and chest portion 160 are generally described as covering the user's shoulder and chest, respectively, it will be recognized that the shoulder portion 142 may actually extend to a portion of the wearer's chest, and the chest portion 160 may actually extend to a portion of the wearer's shoulder.

The chest portion 160 also includes a complimentary back section (not shown in FIG. 1) that is configured to cover a corresponding portion of a user's back. In the embodiment of FIG. 1, the shoulder portion 142 and chest portion 160 are generally comprised of the same material as the sleeve 122 of the arm warmer 110. In various other embodiments described in further detail below, the shoulder portion 142 or chest portion 160 may be comprised of other material such as a relatively rigid material or a foam material. The chest portion 160 may include an outer layer 162 (shown in FIG. 1) and an inner layer 166 (shown in FIG. 2) with a pocket 167 in between. An opening 168 to this pocket is provided along the front left side of the chest portion 160. This opening 168 may be configured to receive weights, such as a plate, that urges the chest portion 160 into engagement with the chest of the wearer. Additional embodiments of the arm warmer 110 with weights retained on the torso portion are described below with reference to FIGS. 23-24.

The shoulder harness 170 is connected to the chest portion 160 and is configured to rest on an opposite shoulder of the user from the chest portion 160. In the embodiment of FIGS. 1-4, the shoulder harness 170 includes straps 172 and a shoulder anchor 174. The shoulder anchor 174 is configured to rest on the opposite shoulder of the user from the chest portion 160. The shoulder anchor 174 includes a frame 176 and an inner shoulder pad 178.

The frame 176 of the shoulder anchor 174 is comprised of a relatively rigid structure. Accordingly, the frame 176 may be comprised of a compression molded plastic material such as polyethylene. The frame 176 is contoured in a convex shape and is configured to rest on the upper shoulder of the wearer. The frame includes a plurality of strap couplings 180 that retain the straps 172 of the shoulder harness 170.

Figure 3:
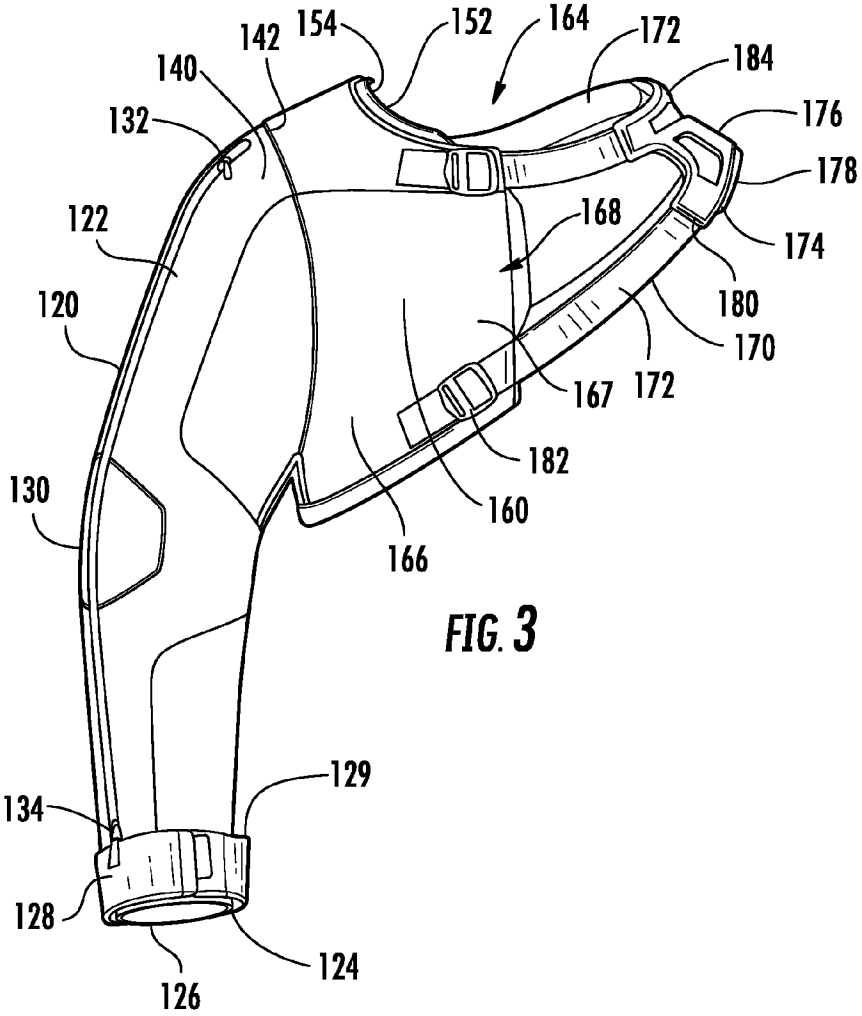
FIG. 3 shows a front view of the arm warmer of FIG. 1 with an outer layer removed to expose buckles on a shoulder harness.

The straps 172 of the shoulder harness 170 extend between the chest portion 160 and the shoulder frame 176. In particular, as shown in FIG. 3, the straps extend between the strap couplings 180 on the frame 176 and ladder lock buckles 182 connected to the chest portion 160. The ladder lock buckles 182 allow the length of the straps to be adjusted such that the torso portion 150 may be adjusted to properly fit the user and comfortably retain the arm warmer 110 on the user. As in FIGS. 1 and 3, the ladder lock buckles 182 may be concealed on the pocket 167 between the outer fabric layer 162 and the inner fabric layer 166 of the chest portion 160.

The frame 176 of the shoulder anchor 174 further includes a handle 184 along the neck opening 164. The handle 184 is provided as a raised surface on the frame 176 that is designed and dimensioned to receive the fingers of the user. Accordingly, the user may easily and conveniently grasp the frame 176 at the handle 184 in order to carry or otherwise manipulate the arm warmer 110.

Figure 4:
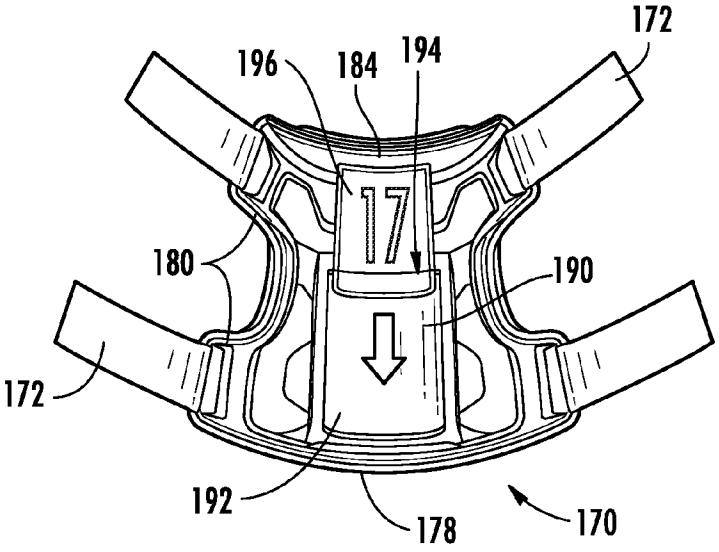
FIG. 4 shows a side view of the shoulder harness of the arm warmer of FIG. 1.

With particular reference now to FIG. 4, the frame 176 of the shoulder anchor includes a central pocket 190 that is configured to receive a customized printed material. The central pocket 190 includes a transparent window 192 that faces the exterior side of the frame 176. The transparent window 192 is generally comprised of a transparent sheet of a polymer material. The transparent window 192 may also be comprised of other materials or may be completely void such that the window is an open window. An opening 194 to the central pocket 190 is provided along an upper side portion of the transparent window 192. The opening 194 is sufficiently sized and shaped to receive a card 196 or other media having a logo, text, or design printed thereon. For example, a card 196 with a team logo and/or player number may be inserted into the pocket 190 to decorate the arm warmer 110 or identify ownership of the arm warmer 110.

The shoulder anchor 174 also includes an interior shoulder pad 178 that is positioned inside of the frame 176 and comprised of a grippy material. The grippy material for the interior shoulder pad 178 will generally be the same as the material used for the shoulder pad 154 on the opposing shoulder, as described above. Accordingly, the shoulder pad 178 provides an interior surface with a high coefficient of friction that resists slippage when engaged with the shirt of the user. Moreover, the grippy material used for both shoulder pads 178 and 154 is relatively flexible and soft, thus providing comfort to the user.

With particular reference again to FIG. 1, when the arm warmer 110 is worn by the user, the torso portion 150 and shoulder harness 170 extend from a position under the user's throwing arm to the shoulder opposite the throwing arm without encircling the torso of the wearer below the shoulders. Therefore, even though the arm warmer 110 covers an area under the user's throwing arm in the embodiment of FIGS. 1-4, the arm warmer 110 does not extend to a position under the opposite (non-throwing) arm of the user. The user may don the arm warmer 110 by simply passing his or her head through the neck opening 164 and inserting his or her throwing arm into the sleeve 122. The sleeve 122 helps keep the user's throwing arm and associated shoulder warm while allowing the rest of the body to remain cool.

Embodiment with Internal Compression and Sleeve Reinforcements

With reference now to FIGS. 5-8 an alternative embodiment of the arm warmer 110 is shown by arm warmer 210. In this embodiment, the arm warmer 210 is similar to the arm warmer 110 shown in FIGS. 1-4, but the arm warmer 210 in FIGS. 5-8 does not include the shoulder harness 170. Additionally, the arm warmer 210 includes a plurality of reinforcement members 212 on the sleeve 222. Moreover, the arm warmer 210 includes a zipper arrangement 230 that is configured to provide ventilation and/or compression to the arm of the user.

Figure 5:
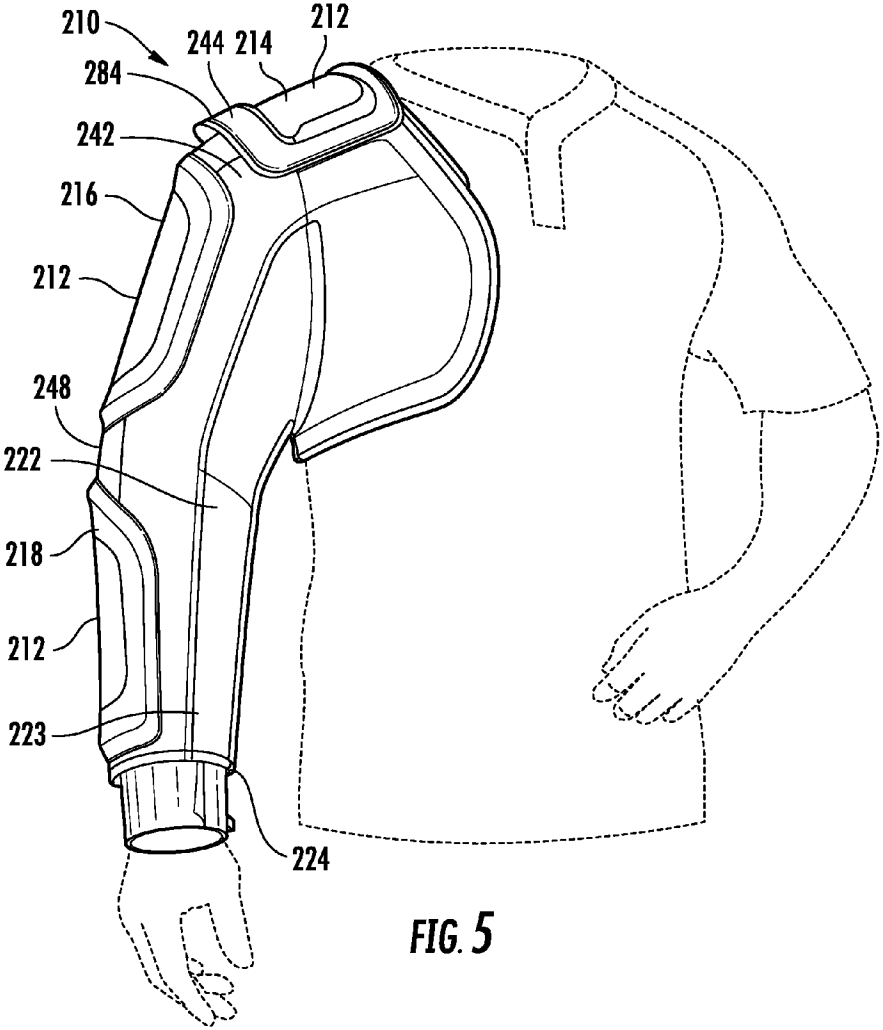
FIG. 5 shows a front view of an alternative embodiment of the arm warmer of FIG. 1 with multiple reinforcement members positioned on the sleeve.
Figure 6:
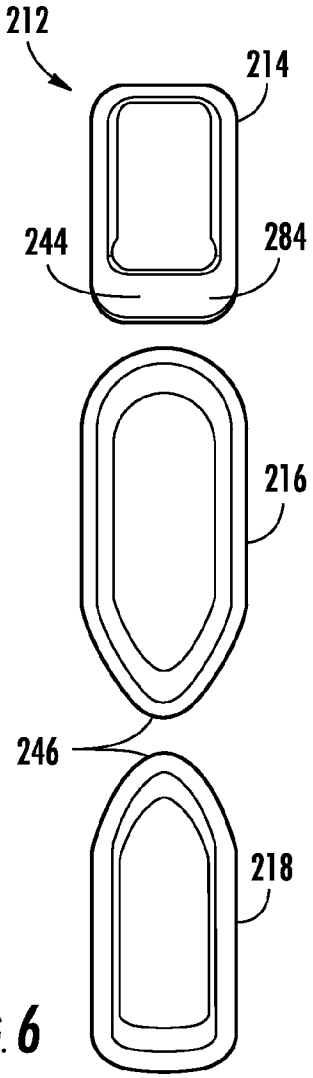
FIG. 6 shows a side view of the reinforcement members of FIG. 5.

As shown in FIGS. 5 and 6, the plurality of reinforcement members 212 include a shoulder support 214, an upper arm support 216, and a forearm support 218. The various reinforcement supports 212, 214 and 216 are provided on the sleeve 222 to provide some rigidity to the sleeve 222 while still allowing for user mobility. The reinforcement supports 212 are generally comprised of a relatively heavy material that adds weight to the sleeve 222 and stabilizes the sleeve by providing a shell-like effect on the outer surface of the sleeve 222. In at least one embodiment, the reinforcement supports may be comprised of heavy duty ballistic nylon or similar material. In another exemplary embodiment, the reinforcement supports may be comprised of a natural or synthetic rubber material, ethylene-vinyl acetate (EVA) or thermoplastic polyurethanes (TPU). The reinforcement supports 212 may be formed by any of various processes such as compression molding.

As shown in FIG. 6, the reinforcement supports 212 may be provided in various shapes. The shoulder support 214 is generally rectangular and includes a raised portion 244 (as best shown in FIG. 5) that provides a handle 284 for the arm warmer 210. The handle 284 is designed and dimensioned to receive the fingers of the user, allowing the user to easily and conveniently grasp the shoulder support 214 at the handle 284 in order to carry or otherwise manipulate the arm warmer 210. Both the upper arm support 216 and the forearm support 218 are somewhat rectangular and include pointed portions 246 that point toward an elbow on the sleeve 222.

Figure 7:
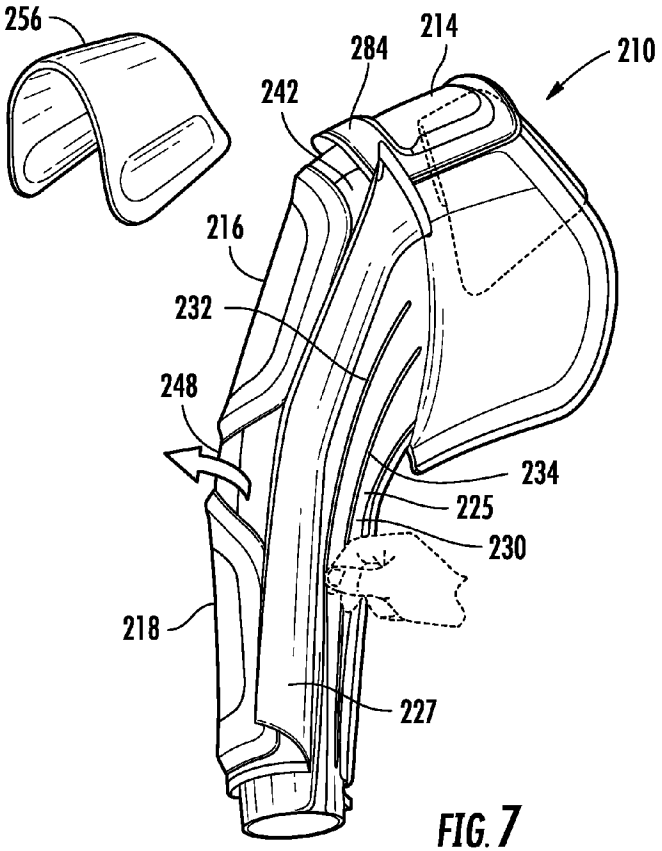
FIG. 7 shows a front view of the arm warmer of FIG. 1 including an internal shoulder clip and a zipper arrangement on the sleeve.

With reference now to FIG. 7, the arm warmer 222 may provide further reinforcement by including a shoulder clip 256 on the inside of the shoulder portion 242. The shoulder clip 256 is a resilient member that is configured to wrap around the shoulder of the user and gently squeeze the shoulder, providing a compressive effect on the shoulder. The shoulder clip 256 may be comprised of any of various materials such as a foam material or a plastic material.

In addition to the reinforcement supports 212 and the shoulder clip 256, the arm warmer 210 in the embodiment of FIGS. 5-8 further includes a zipper arrangement 230 that provides for ventilation and adjustable compression on the sleeve 222. As best shown in FIG. 7, the sleeve 222 includes an outer fabric layer 223 and an inner fabric layer 225. The reinforcement supports 212 are provided on the outer fabric layer 223, and the zipper arrangement 230 is provided on the inner fabric layer 225. The outer fabric layer 223 includes a flap 227 that may be pulled back to reveal the zipper arrangement on the inner fabric layer 225. The flap 227 may be secured on the outer fabric layer 223 using any of various means known in the art, such as a hook and loop arrangement.

Figure 8A:
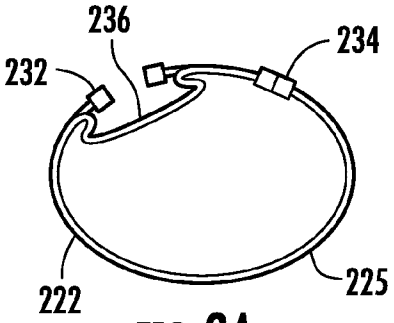
FIG. 8A shows a cross-sectional view of the zipper arrangement of FIG. 8 along line VII-VIII with the zipper arrangement in a first position.
Figure 8B:
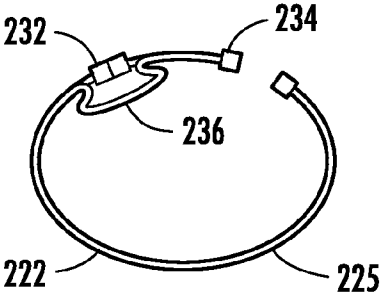
FIG. 8B shows a cross-sectional view of the zipper arrangement of FIG. 8 in a second position.
Figure 8:
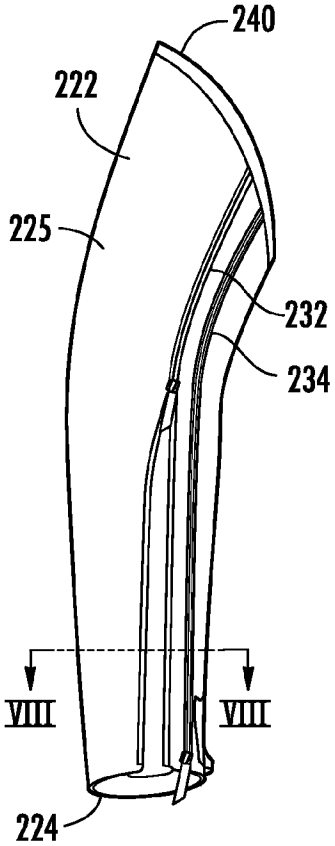
FIG. 8 shows a front view of the sleeve of the arm warmer of FIG. 5.

As best shown in FIG. 8, the zipper arrangement 230 on the inner fabric layer 225 includes a first zipper 232 and a second zipper 234. The first zipper 232 and the second zipper 234 extend from the wrist end 224 to the shoulder end 240 of the arm 222 in the embodiment of FIG. 8. However, in other embodiments, the zippers 232, 234 may only extend along a portion of the sleeve 222, such as from the wrist end 224 to the elbow. Because the fabric on the inner fabric layer 225 is a compression material, closing (i.e., unzipping) the zippers 232 and 234 will increase the compression provided by the inner fabric layer 225, while opening (i.e., zipping) the zippers 232 and 234 will decrease the compression provided by the inner fabric layer 225.

FIG. 8A, shows a cross-sectional illustration of the first zipper 232 and the second zipper 234 on the sleeve 222 along line VIII-VIII of FIG. 8. The first zipper 232 is shown in an open position (i.e., unzipped state), and the second zipper is shown in a closed position (i.e., zipped state). The first zipper 232 includes a backing layer 236 comprised of a fabric material. This fabric material on the backing layer 236 may be a compression material, similar to the other material on the inner fabric layer 225, or may be another type of fabric material. In any event, the backing layer 236 is provided on the inside of the zipper elements for the first zipper 232 and limits the distance that opposing sides of the first zipper 232 may be removed from each other on the sleeve 222. Accordingly, when the first zipper 232 is opened, as shown in FIG. 8A, and the second zipper 234 is closed, the sleeve 222 retains some degree of compression since the distance between the opposing sides of the first zipper 232 is limited by the backing layer 236. However, if the second zipper 234 is opened, as shown in FIG. 8B, no compression will be provided by the sleeve 222 because no backing layer is provided behind the second zipper 234. Accordingly, the first zipper 232 and the second zipper 234 on the sleeve 222 may be used to provide the user with an adjustable degree of compression on his or her throwing arm. In particular, at least three different levels of adjustability are provided by the zipper arrangement, including no compression (i.e., FIG. 8B), low compression (i.e., FIG. 8A), and high compression (i.e., both the first zipper 232 and the second zipper 234 closed). Additionally, it will be recognized that the zipper arrangement 230 also provides for ventilation to the user's arm, if desired, by opening the flap 227 on the sleeve 222 and opening the second zipper 234.

Embodiment with Sleeve Reinforcements and Adjustable Vents

Figure 9:
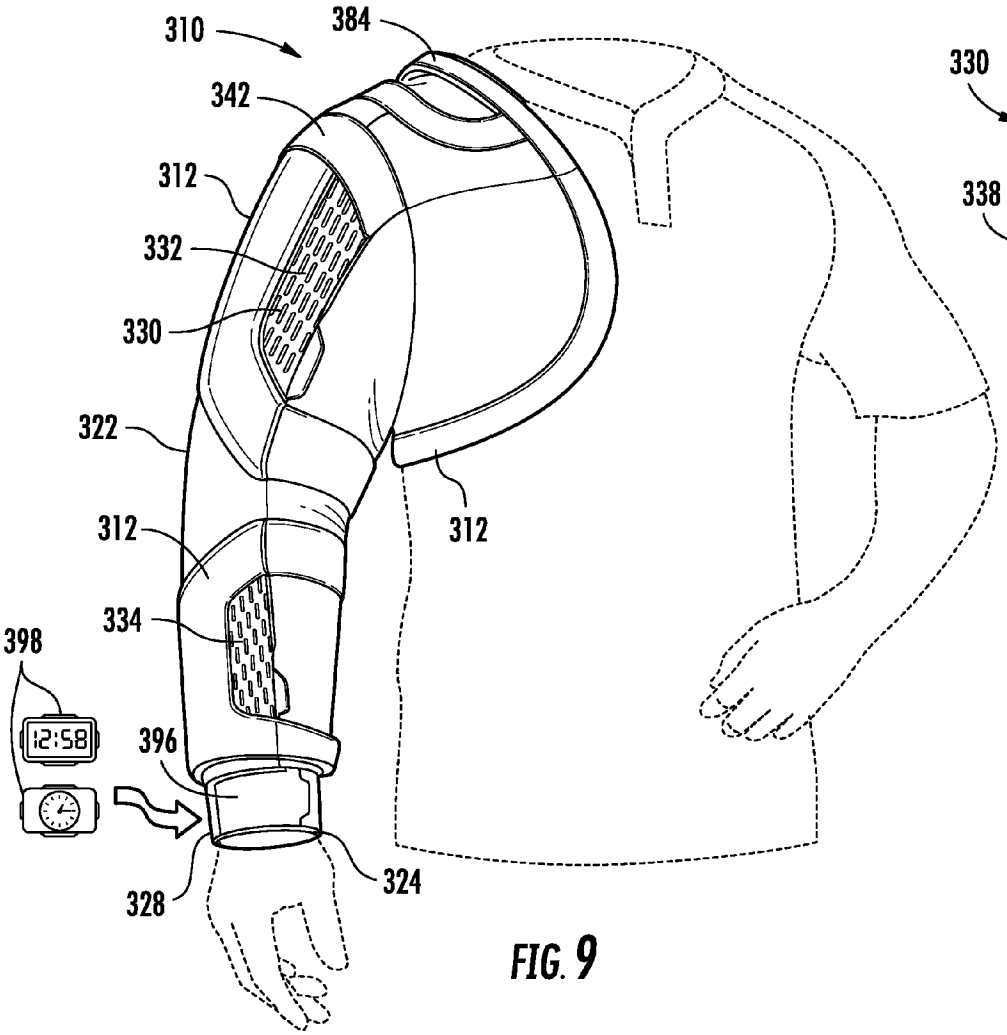
FIG. 9 shows a front view of another alternative embodiment of the arm warmer of FIG. 1 with an adjustable vent arrangement.
Figure 12:
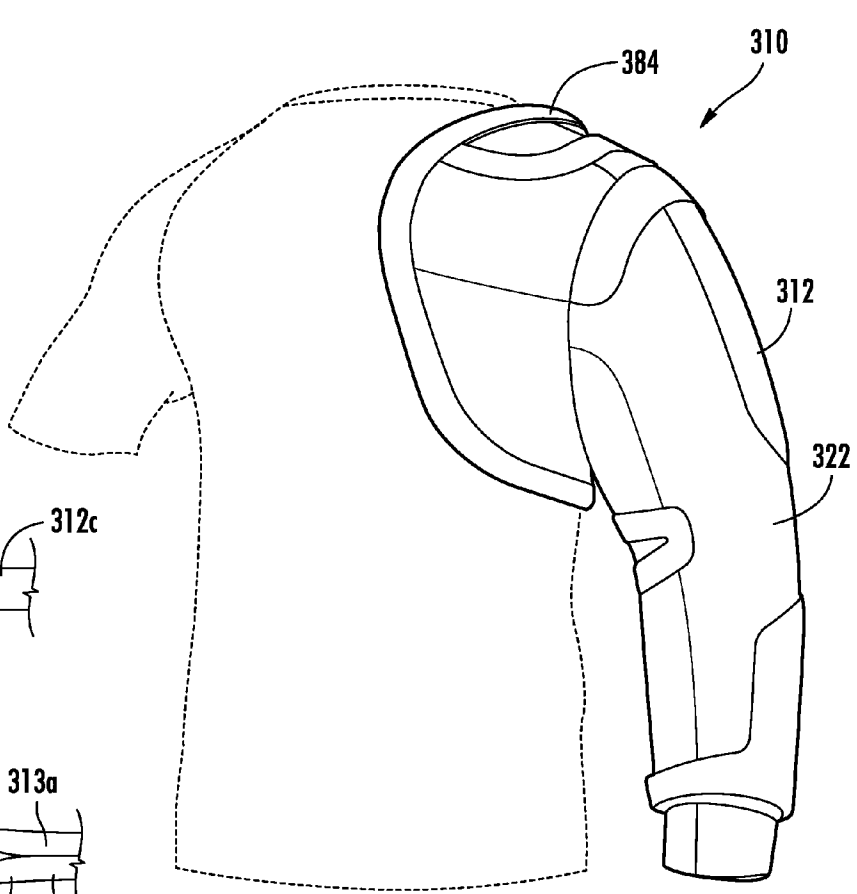
FIG. 12 shows a back view of the arm warmer of FIG. 9.

With reference now to FIGS. 9-12 another alternative embodiment is shown by arm warmer 310. In this embodiment, the arm warmer 310 is similar to the arm warmer 210 shown in FIGS. 5-8, but the arm warmer 310 in FIGS. 9-12 includes a different reinforcement arrangement and does not include the adjustable zipper arrangement. With particular reference to FIG. 9, in this embodiment, the arm warmer device includes a plurality of reinforcement bands 312. The reinforcement bands 312 are provided on the sleeve 322 to help hold the sleeve 322 on the shoulder of the user while still allowing for mobility. The reinforcement bands 312 are generally comprised of a relatively heavy material that adds weight to the sleeve 322 and stabilizes the sleeve by providing a shell-like effect on the outer surface of the sleeve 322. In at least one embodiment, the reinforcement supports may be comprised of heavy duty ballistic nylon, TPU, or similar material. In another exemplary embodiment, the reinforcement bands 312 may be comprised of a natural or synthetic rubber material. The reinforcement bands 312 may be formed by any of various processes such as compression molding. In the embodiment of FIGS. 9-12, the reinforcement bands 312 are covered with a decorative feature such as nubuck leather.

One or more hinges 314 may be used in association with the reinforcement bands 312 on the arm warmer 310. Each hinge 314 allows the generally rigid reinforcement bands 312 to be folded in strategic locations in order to facilitate collapse of the arm warmer 310. For example, in the embodiment of FIG. 11, radial reinforcement band 312*b* extends between lateral reinforcement band 312*a* and medial reinforcement band 312*c* on the shoulder portion 342 of the arm warmer 310. A hinge 314 is positioned on the radial reinforcement band 312*b*. The hinge 314 allows the radial reinforcement band 312*b* to fold or collapse at the hinge 314, thus allowing the arm warmer 310 to be reduced in size for storage.

Figure 11:
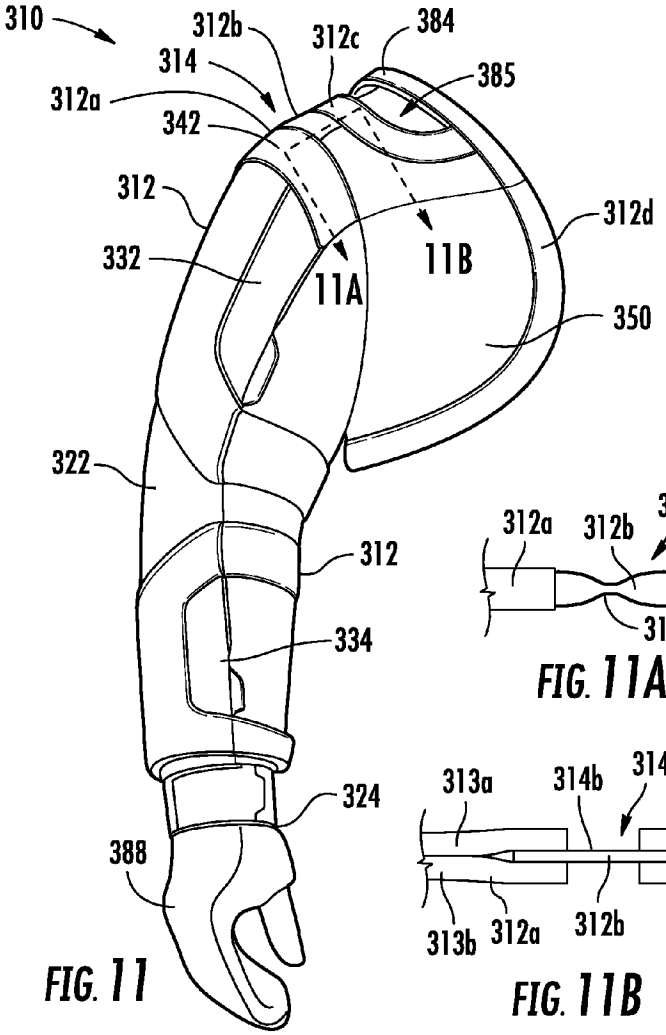
FIG. 11 shows a front view of the arm warmer of FIG. 9 with a hand warmer mitt extended from the sleeve.
Figure 11A:
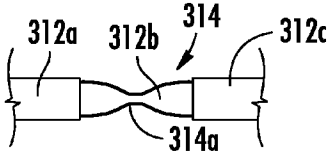
FIG. 11A shows a cross-sectional view along line A-B of FIG. 11 showing one embodiment of a hinge on the arm warmer.
Figure 11B:
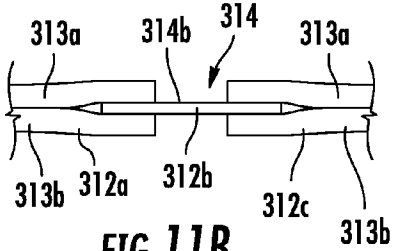
FIG. 11B shows a cross-sectional view along line A-B of FIG. 11 showing another embodiment of a hinge on the arm warmer.

The hinge 314 may be provided in any of various forms such as a living hinge or other hinge means. An exemplary cross-section of the hinge 314 on the radial reinforcement band 312*b* is shown in FIG. 11A. In the embodiment of FIG. 11A, the hinge 314 is integrally formed on the radial reinforcement band 312*b*, which is comprised of the same material as the lateral reinforcement band 312*a* and the medial reinforcement band 312*c*. In at least one embodiment, the living hinge may be comprised of a polyethylene, polypropylene, or other material having sufficient fatigue resistance qualities. As illustrated in FIG. 11A, the living hinge 314 includes a thinned portion 314*a* having more flexibility than the remainder of the reinforcement band 312*b*. Accordingly, the thinned portion 314*a*, which is integrally formed with the other portions of the reinforcement band 312*b*, provides a bend line for the radial reinforcement band 312*b*. In the embodiment of FIG. 11A, the living hinge 314 is integrally formed with the adjacent portions of the reinforcement bands 312*a-c*, however, it will be recognized that in other embodiments the living hinge 314 may be mechanically connected to adjacent portions of the reinforcement bands. For example, as shown in FIG. 11B, the hinge 314 may include a thinned portion 314*b* that is sandwiched between adjacent portions of the reinforcement bands 312 and welded or adhered to the adjacent portions of the reinforcement bands 312.

In yet another embodiment, the hinge 314 on the reinforcement band 312*b* is provided in the form of a flexible webbing extending between two portions of reinforcement bands 312 comprised of a significantly harder material. The flexible webbing may be, for example, a flexible fabric material comprised of woven polyester or any of various other materials. An example of such a flexible webbing is shown in FIG. 11B, where the thinned portion 314*b* is the webbing. As illustrated in FIG. 11B, the flexible webbing 314*b* is connected between reinforcement band 312*a* and 312*c*. Connection of the flexible webbing 314*b* may be made by various means such as adhesives or heat welding. In the embodiment of FIG. 11B, the flexible webbing 314*b* is sandwiched between an outer layer 313*a* and an inner layer 313*b* of the radial reinforcement band 312*b*.

A handle 384 is incorporated into the torso portion 350 of the arm warmer 310. In the embodiment of FIG. 11, the handle 384 is provided as a part of one of the reinforcement bands 312*d* that extends along the perimeter of the chest portion 360 and the shoulder portion 342 of the arm warmer 310. In this embodiment, the handle 384 is provided by a raised portion on the reinforcement band 312*d* that bridges from front of the shoulder portion 342 to the rear of the shoulder portion 342. An opening 385 is provided in the torso portion 350 adjacent to the handle 384. The opening 385 is designed and dimensioned to receive the fingers of the user, allowing the user's fingers to engage and wrap around the handle 384. Accordingly, the handle 384 allows the user to easily and conveniently grasp the arm warmer 310 at the handle 384 in order to carry or otherwise manipulate the arm warmer 310. The handle 384 may be comprised of any of various materials, including the same material as the reinforcement bands 312 (e.g., heavy duty ballistic nylon or TPU) or a different material than the reinforcement bands 312. For example, in at least one embodiment, the handle 384 is comprised of a flexible material in the form of a reinforced fabric.

With particular reference to FIG. 9, the wrist end 324 of the sleeve 322 includes a flap 396 that may be used to conceal a pocket in the outer cuff 328. The pocket is configured to hold a personal electronic device 398, such as a timepiece, MP3 player, or communications device. The flap 396 may be comprised of a rubber or other resilient material that helps protect the device 398 in the pocket.

Figure 10:
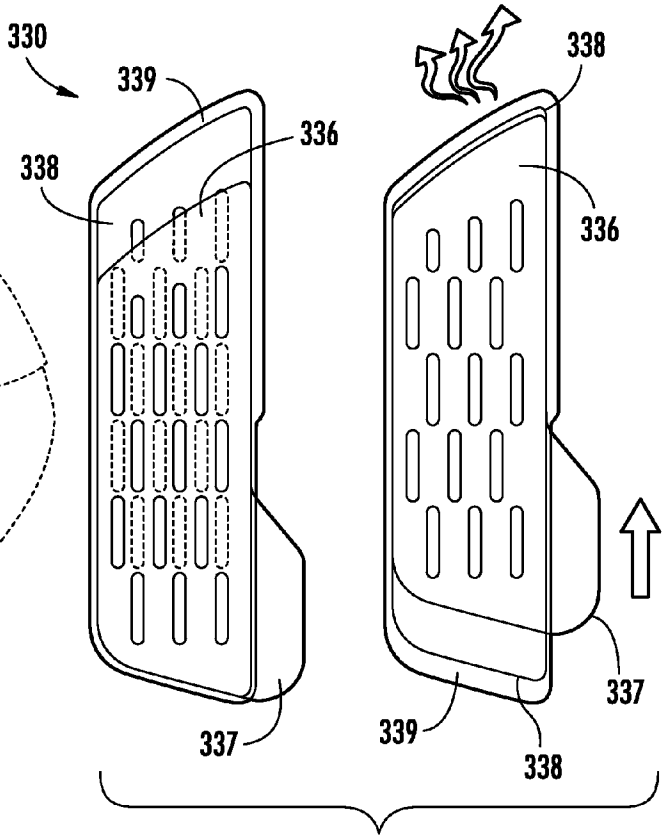
FIG. 10 shows an illustration of operation of the adjustable vent arrangement of the arm warmer of FIG. 9.

The sleeve 322 also includes adjustable vents 330 positioned between the reinforcement bands 312. In particular, the sleeve 322 includes an upper arm vent 332 and a forearm vent 334. As shown in FIG. 10, each adjustable vent 330 includes a first panel 336 with a first plurality of holes and a second panel 338 with a second plurality of holes. The first panel 336 and the second panel 338 are generally comprised of a material that is not air permeable, such as a thin plastic material. The first panel 336 and the second panel 338 are retained within a mesh pocket 339 on the sleeve 322. The second panel 338 is approximately the same size as the pocket 339, and is not moveable within the pocket 339. However, the first panel 336 is smaller than the mesh pocket 339 such the first panel 336 it is moveable within the pocket 339 between a first position (shown on the left side of FIG. 10) and a second position (shown on the right side of FIG. 10). The first panel 336 also includes a tab 337 to assist the user in moving the panel 336 within the pocket 339. When the first panel 336 in the first position, the holes in the first panel 336 do not align with the holes in the second panel 338, and air is blocked from passing through the vent 330. However, when the first panel 336 is in the second position, the holes in the first panel 336 align with the holes in the second panel 338, and air is allowed to pass through the vent 330. Furthermore, because the holes are elongated, the user may position the first panel 336 at any position between the first and second positions (shown in FIG. 10) to adjust the degree of ventilation provided by the vent 330.

With particular reference now to FIG. 11, the sleeve may further comprise a hand warmer mitt 388 that is attached to the wrist end 324 of the sleeve 322. The mitt may be tucked into the sleeve 322 when not in use, and may be extended from the sleeve 322 when the user desires to warm his or her hand. Additional alternative embodiments of the arm warmer with a hand mitt are described bellow with reference to FIGS. 30-32.

Embodiment with Wrapping/Quick Release Sleeve

Figure 14:
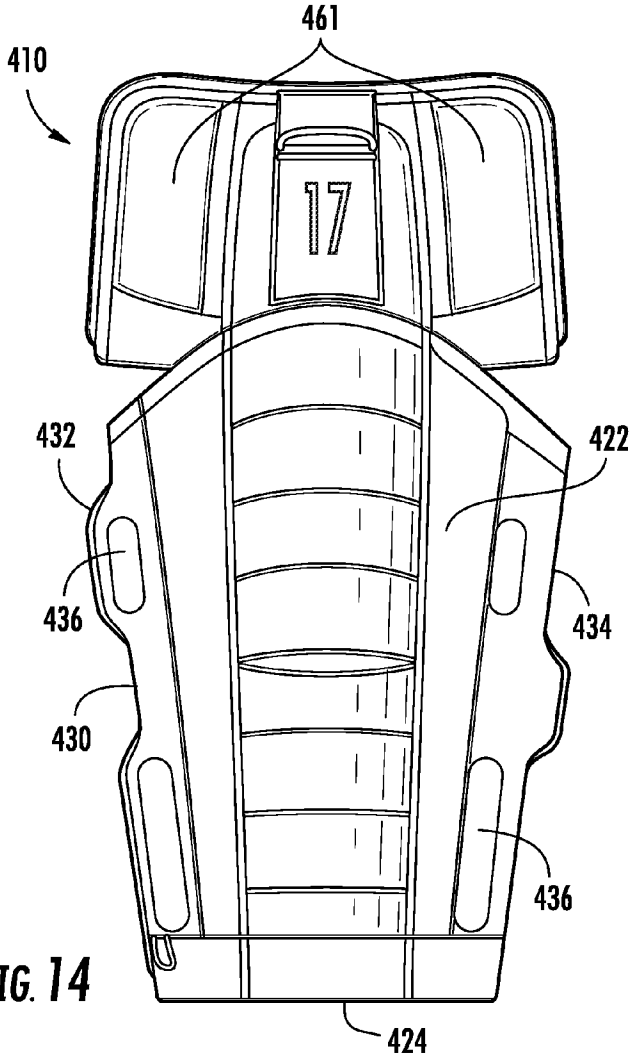
FIG. 14 shows the exterior of the arm warmer of FIG. 13 in an open position.
Figure 13:
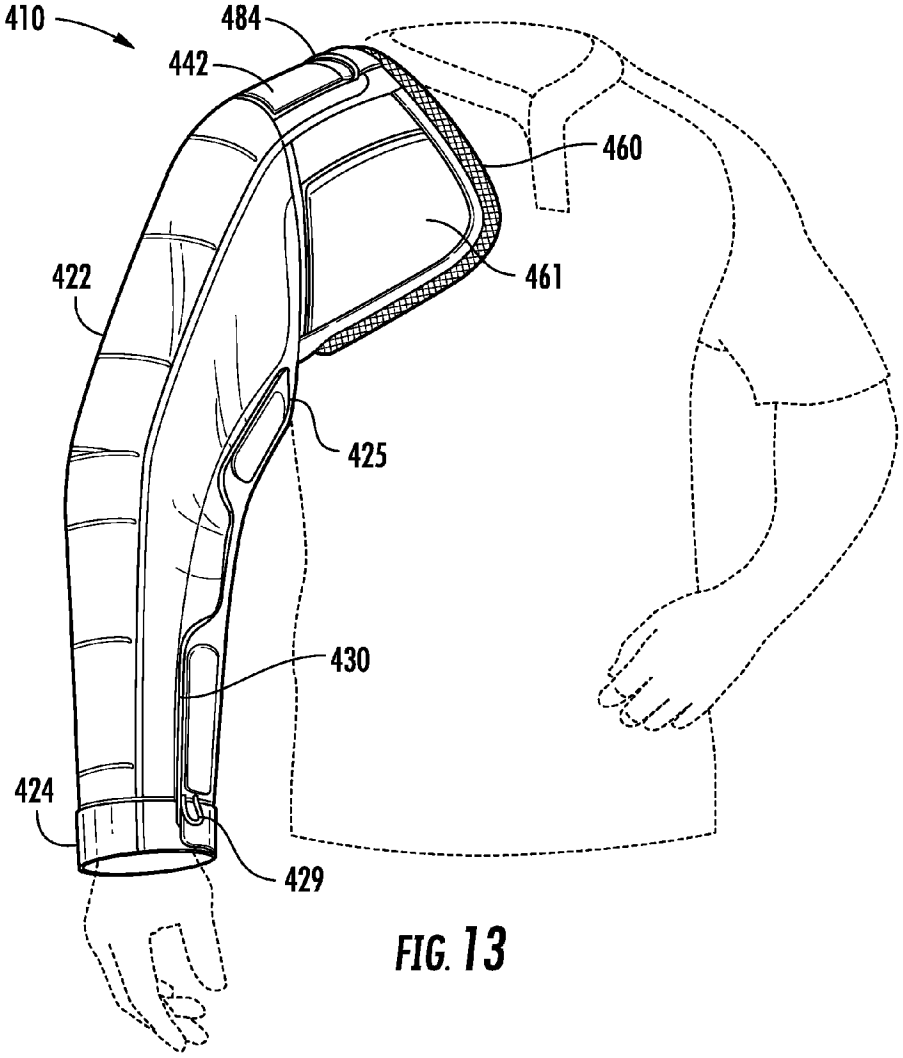
FIG. 13 shows a front view of yet another alternative embodiment of the arm warmer of FIG. 1 with a wrapping/quick release sleeve.
Figure 15:
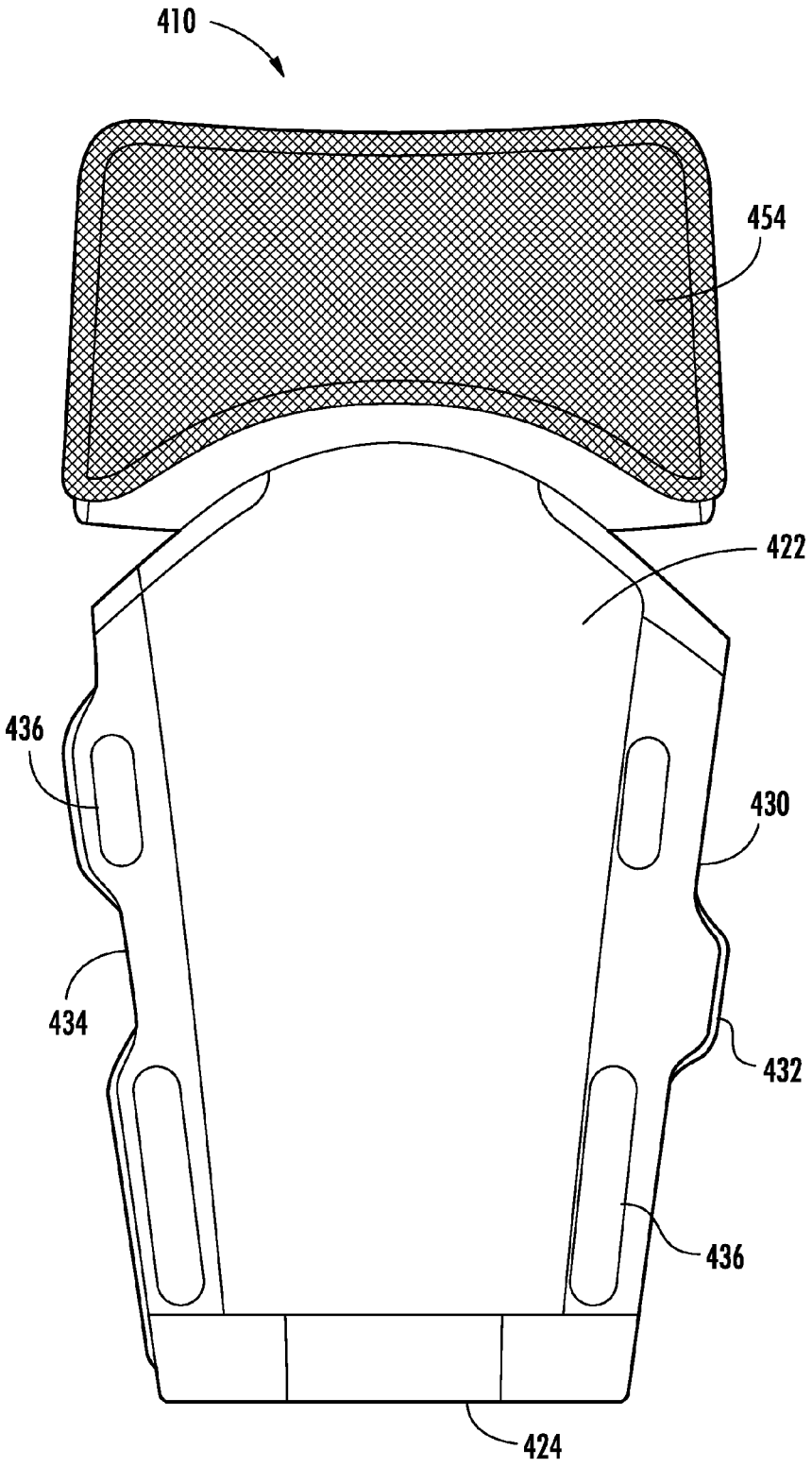
FIG. 15 shows the interior of the arm warmer of FIG. 13 in the open position.

With reference now to FIGS. 13-15 yet another alternative embodiment is shown by arm warmer 410. In this embodiment, the arm warmer 410 is configured with a releasable seam 430 that allows the user to wrap the sleeve 422 of the arm warmer 410 around his or her arm instead of inserting his or her arm into the sleeve. The releasable seam 430 extends along the entire length of the medial side of the sleeve 422 between the wrist portion 424 and an underarm portion 425. The releasable seam 430 includes a first edge 432 and a second edge 434 with a plurality of fastening members 436 provided along the first edge 432 and the second edge 434. The plurality of fastening members 436 provided along the first edge 432 are complimentary to the fastening members 436 provided along the second edge 434. In the embodiment of FIGS. 13-15, the fastening members 436 are magnets embedded in the sleeve 422. However, it will be recognized that various other fastening members are possible, such as hook and loop fasteners, snaps, zippers, or other fasteners as will be recognized by those of skill in the art.

The fastening members 436 allow the user to fasten the first edge 432 of the seam 430 to the second edge 434 of the seam 430, thus forming the sleeve in standard cylindrical form, as shown in FIG. 13. Alternatively, the fastening members 436 may be released from one another to allow the sleeve 422 to be laid flat as shown in FIGS. 14 and 15. This ability to transform from a first form (i.e., a cylindrical form) to a second form (i.e., a flat form) allows the user to quickly and easily don the arm warmer 410 or remove the arm warmer 410 from his or her arm.

The chest portion 460 of the arm warmer 410 includes weighted sections 461, each weighted section including at least one weight that helps retain the sleeve 422 on the user by urging the chest portion 460 into engagement with the wearer's chest. In particular, the weighted sections 461 drape over the user's shoulder, providing stability and strength the arm warmer 410. Moreover, a shoulder pad 454 is provided on the inside of the chest portion 460. The shoulder pad 454 is comprised of a grippy material that provides an interior surface with a relatively high coefficient of friction, similar to the shoulder pad 154 of FIGS. 1-4.

The arm warmer 410 of FIGS. 13-15 may be provided with various features previously described for other embodiments, whether such features are in the same form or a modified form. For example, as shown in FIGS. 13 and 14, the arm warmer 410 may include a handle or hanging tool provided by a first shock cord 484 in the shoulder portion 442 of the arm warmer 410. Similarly, a second shock cord 429 at the wrist end 424 of the sleeve 422 provides a thumb grip for the sleeve 422.

Embodiment with Quilted Sleeve and Relatively Rigid Body

With reference now to FIG. 16-19, yet another alternative embodiment of the arm warmer 510 is shown. In this embodiment, the arm warmer 510 includes a single arm 520 and a torso portion 550. Similar to the embodiment of FIGS. 1-4, the single arm 520 includes a sleeve 522 having a wrist end 524 and a shoulder end 540. The wrist end 524 includes an interior cuff 526 and an exterior cuff 528. The exterior cuff 528 generally extends over and covers the interior cuff 526 at the end 524 of the sleeve 522. The exterior cuff 528 is shown in partial transparency in FIG. 16 to show placement of the interior cuff 526 relative to the exterior cuff 528. The interior cuff 526 is generally comprised of an elastic material that expands to allow the wearer's hand to pass through and contracts to hold closely to the wearer's wrist. Accordingly, the elastic interior cuff 526 acts to retain heat within the sleeve by closing around the wrist of the wearer and preventing heat from escaping at the end of the sleeve 522.

The sleeve 522 is generally comprised of a fabric material that is capable of retaining heat and providing a warming effect to the athlete's arm and shoulder. Accordingly, the sleeve 522 may be comprised of a knit, woven, or non-woven construction, or a combination of such constructions. For example, the sleeve may be comprised of a quilted polyester material with padding included in quilted pockets to provide an insulating effect. As another example, the sleeve may include a two-layer construction where two different fabrics are combined to provide the desired effect. In such a two-layer construction, an inner layer closest to the skin may be used to wick moisture away from the skin. An outer layer may be used to provide warmth to the wearer's arm. In at least one embodiment, a layer of fabric comprised of a heat reflecting material may be used to provide a warming effect to the athlete's arm and shoulder.

Figures 16, 17:
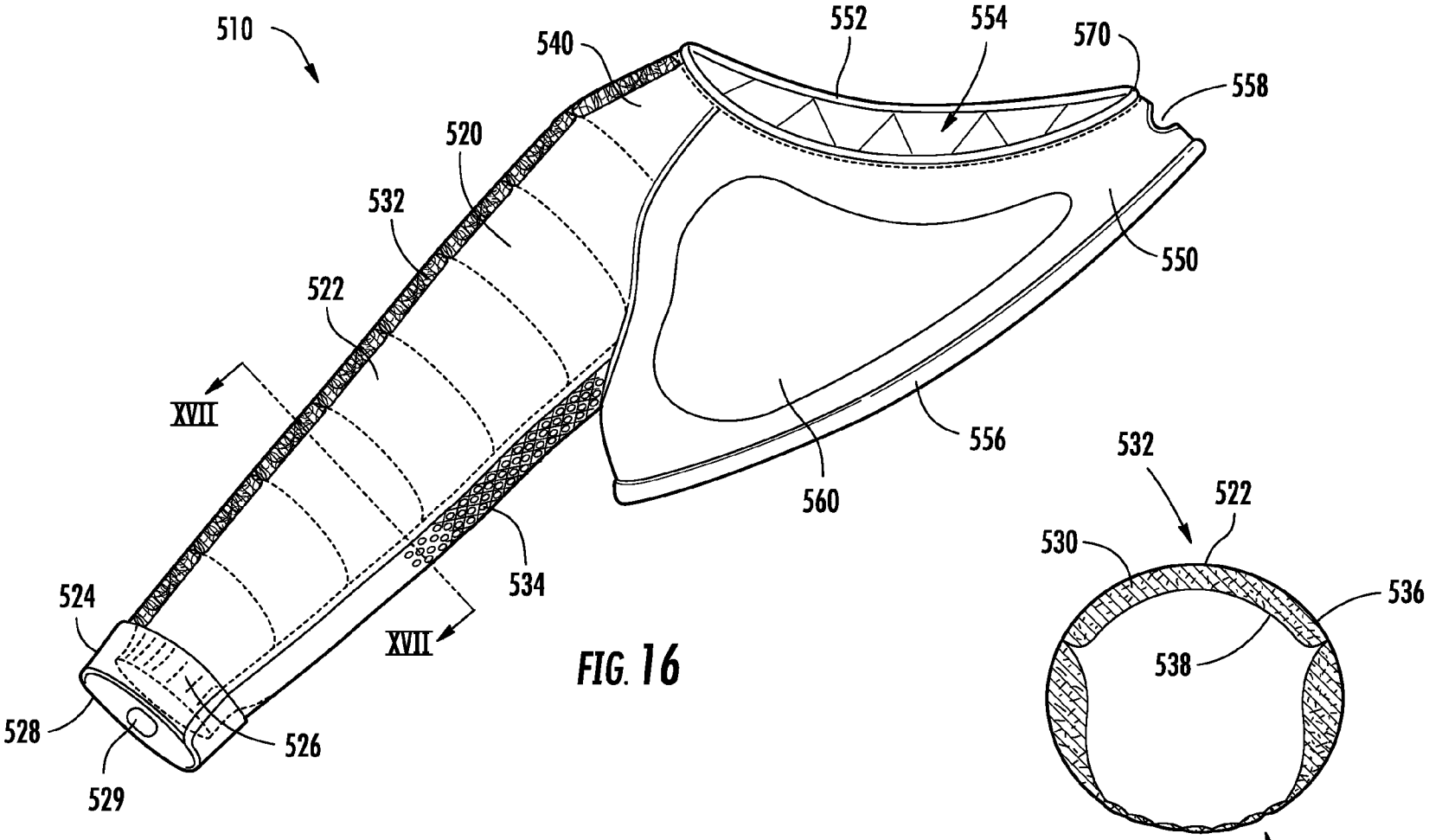
FIG. 16 shows a front view of another embodiment of the arm warmer of FIG. 1.
FIG. 17 shows a cross-sectional view of an arm of the arm warmer of FIG. 16.

In the embodiment of FIGS. 16 and 17, the sleeve 522 includes a quilted lateral side 532 with a mesh inset on a medial side 534. As best seen in FIG. 17, the quilted lateral side 532 includes a first layer 536 of a polyester material and a second layer 538 of a double-knit microfiber material with padding 530 provided between the first layer 536 and the second layer 538. The padding 530 may be comprised of cotton, polyester, or other material as commonly used in jackets and related garments. The medial side 534 of the sleeve 522 extends in a longitudinal direction on the sleeve from an armpit area to the cuff end 524 along the portion of the sleeve 522 closest to the torso of the wearer. The medial side 534 is comprised of a mesh material or other breathable fabric. Accordingly, the medial side 534 acts as a vent in the sleeve that prevents sweat build up and allows air to move within the sleeve 522. In at least one embodiment, a removable outer cover is provided on the vent 534. The cover may be removably positioned over the vent 34 using any of various fastening techniques recognized by those of skill in the art, such as a zipper. In one embodiment, the vent cover may be a zip-off or zip-back-and-tuck arrangement, where the mesh vent 534 can be exposed in the warmer summer months and closed in the cooler months. In yet another possible embodiment, a single zip may be provided along the length of the sleeve, wherein the vent is exposed when the zipper is opened under tension to provide a breathable, stand-alone window in the sleeve.

As shown in FIG. 16, a thumb hole 529 may be provided somewhere on the sleeve 522, such as the exterior cuff 528. The thumb hole 529 is configured to receive the thumb of the wearer, and assist the wearer in removing or donning the warmer device 510. In particular, the thumb hole 529 may be grasped by the opposite hand of the wearer when the user removes his or her arm from the sleeve 522 to prevent the sleeve from turning inside-out. This thumb-hole 529 is especially useful if a compression material such as elastane is used as a fabric for the sleeve 522. The perimeter of the thumb hole 529 may include a durable, relatively rigid or hard material, such as a plastic rim or simply a perimeter of reinforced stitching that provides a ring structure for the user to grab with his or her thumb.

Figure 18:
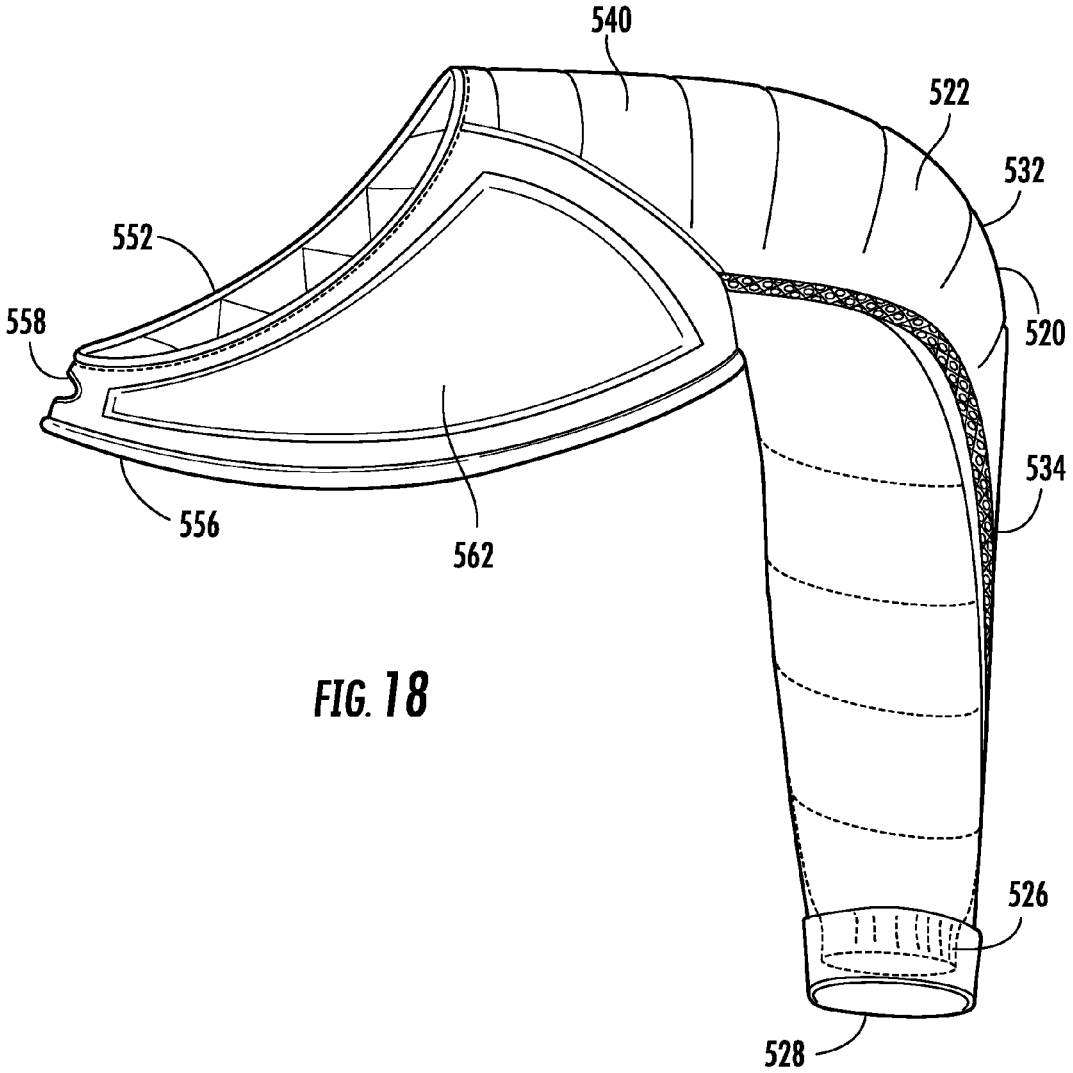
FIG. 18 shows a rear view of the arm warmer of FIG. 16.
Figure 19:
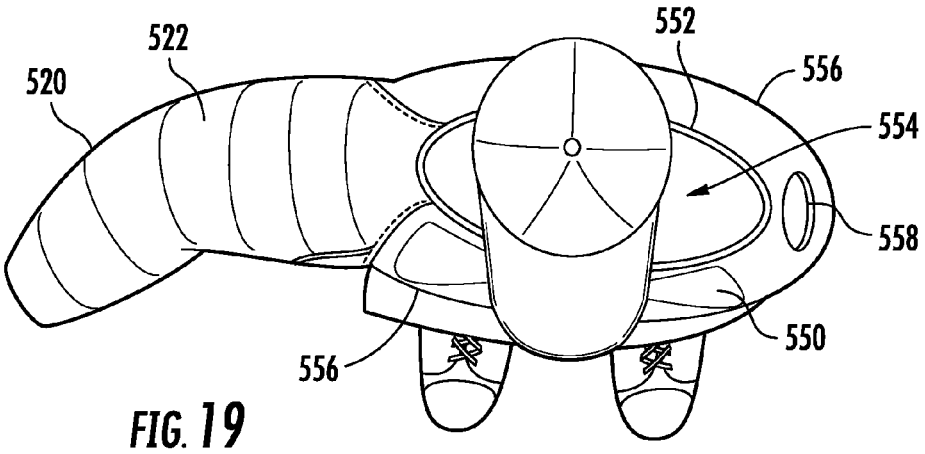
FIG. 19 shows a top view of the arm warmer of FIG. 16 positioned on an athlete.

The torso portion 550 of the arm warmer 510 is connected to the arm portion 520 along the shoulder end 540 of the sleeve 522. The torso portion 550 includes a shoulder harness 570 with a frame having an upper rim 552 and a lower rim 556. The upper rim 552 defines a neck opening 554 configured to pass the wearer's head and encircle the neck area of the wearer. A handle 558 is provided by an opening in the torso portion 550 between the upper rim 552 and the lower rim 556 on the side of the arm warmer 510 opposite the sleeve 522. As illustrated in FIG. 19, the upper rim 552 is configured to rest on the wearer's shoulders with the wearer's neck extending through the neck opening 554. The lower rim 556 extends from a position under the wearer's throwing arm to the shoulder opposite the throwing arm without encircling the torso of the wearer below the shoulders. In other words, in the embodiment of FIGS. 16-19, the lower rim 56 does not extend to a position under the opposite (non-throwing) arm of the wearer.

In the embodiment of FIGS. 16-19, the torso portion 550 is primarily comprised of a relatively rigid plastic material, such as polyethylene. This relatively rigid construction gives the torso portion 550 significant durability and functionality. The torso portion is rigid shoulder harness 570 provides a frame member with the handle 558 formed in the frame. The handle 558 allows the arm warmer 510 to be hung from a hook and stored with other equipment, such as catcher's masks and chest protectors. At the same time, the relatively rigid torso portion 550 allows the athlete to quickly place the device 510 on his or her body by grasping the torso portion 550, placing his or her head through the neck opening 554, and sliding his or her arm into the arm portion 520.

With continued reference to FIG. 16, the torso portion 550 may further comprise a chest section 560 this is integral with or connected to the shoulder harness 570. In the embodiment of FIG. 16, the chest section 560 is comprised of a different material than the shoulder harness and the rest of the torso portion 550. For example, the chest section 560 may be comprised of a high density closed cell foam material. This foam material may be laminated over, adhered to, or otherwise connected to the rigid plastic that forms the shoulder harness 570 for the torso portion 550. Alternatively, the foam material may be formed in a central opening defined by the torso portion. The chest section 560 may be provided primarily for aesthetic purposes in order to give the arm warmer 510 a certain look and feel. However, because the chest section 560 includes a foam material, it may also serve functional purposes, such as providing further insulating properties to the chest area, or protecting the chest from incidental impacts. As shown in FIG. 18, a back section 562 similar to the chest portion 560 may also be provided on the rear of the torso portion 550. Furthermore, although the chest section has been described as comprising a different material than the rest of the torso portion, it may also be comprised of the same material found in the rest of the torso portion or the arm portion.

Although the torso portion 550 in the above-described embodiment is comprised of a relatively rigid plastic material, in other embodiments the torso portion 550 may be comprised primarily of a relatively flexible fabric material, similar to that of the sleeve 522. In these embodiments, the upper rim 552 and the lower rim 556 may be formed of relatively rigid plastic rings that are retained within channels formed by the fabric hems of the torso portion 550. In this configuration, the arm warmer 510 has less bulk and may be stored in a more compact fashion, similar to a shirt or jacket. In at least one embodiment, even though the torso portion 550 is not comprised of a plastic material, it is nevertheless comprised of a fabric material that is more substantial, stable and heavier than the cloth portions of the arm 520. In such embodiments, fabrics may still be used that allow the device to remain lightweight and breathable around the torso of the wearer.

Embodiment with Second Arm Hole

Figure 20:
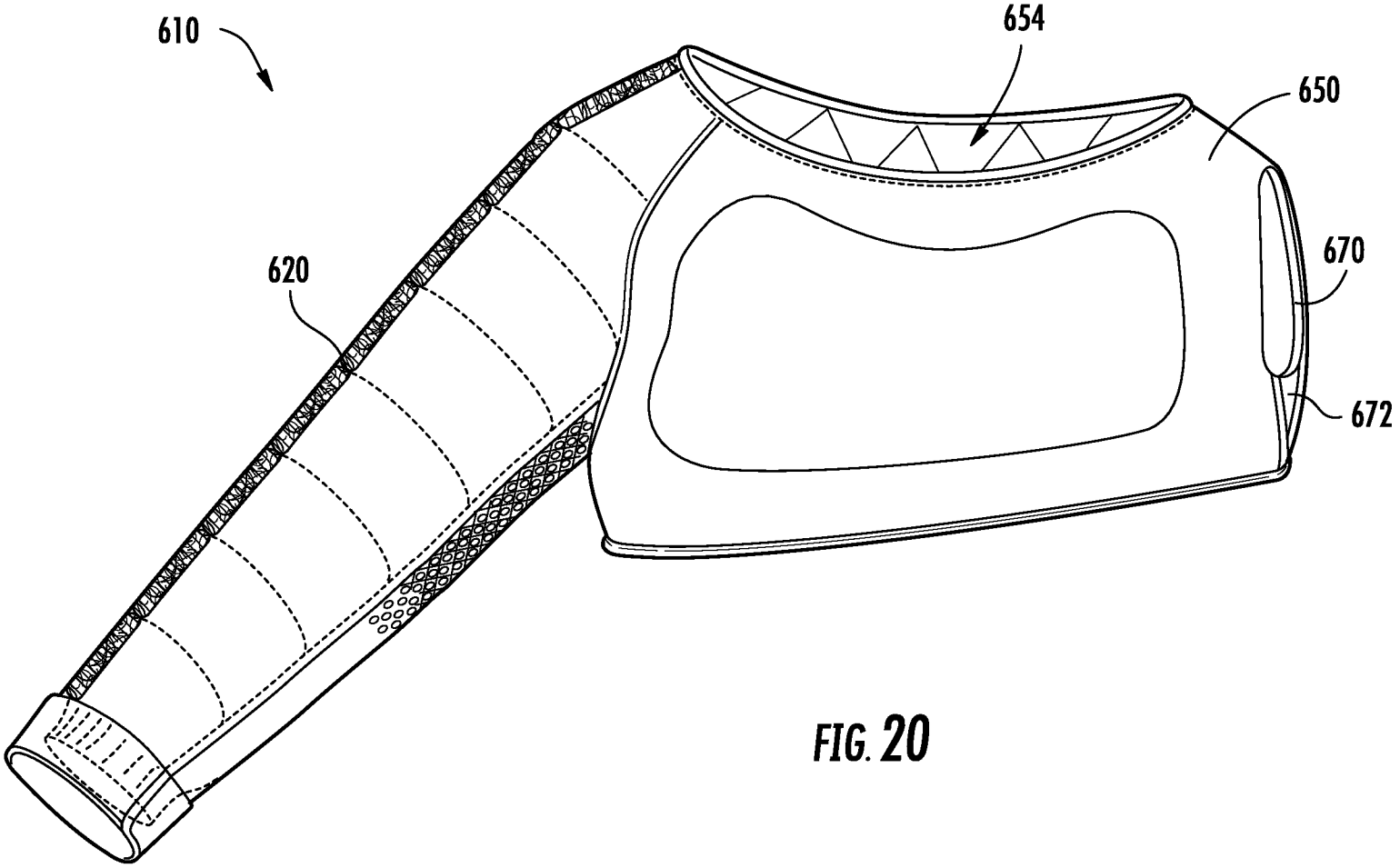
FIG. 20 shows a front view of an alternative embodiment of the arm warmer of FIG. 16.

With reference now to FIG. 20, in at least one alternative embodiment, the entire arm warmer 610, including the arm 620 and the torso portion 650 is comprised of a non-rigid fabric. For example, the arm 620 may be configured as described above with reference to FIGS. 15-19, but the torso portion is free of rigid plastic and is instead comprised of a flexible fabric. In this embodiment, an arm hole 670 is positioned on the opposite side of the torso portion 650 from the single arm 620. The arm hole 670 is configured to receive and pass the non-throwing arm of the wearer. The fabric of the torso portion 650 may comprise a double knit fabric microfiber material or any other appropriate material. In at least one embodiment, the fabric of the torso portion includes a compression material, such as elastane, that tightly conforms to the shape of the wearer. In the embodiment of FIG. 20, a gusset 672 comprised of a compression material such as elastane is provided under the arm hole 670. In at least one alternative embodiment, a second sleeve (not shown) may extend from the arm hole 670. The second sleeve may be comprised of any of various fabrics, such as elastane or other compression material.

The increased use of fabric material in the embodiment of FIG. 20 allows for more movement by the wearer, making this embodiment more appropriate for warm-up activities. Also, because this configuration is free of relatively rigid or harder plastics, it is more comfortable for the wearer during such periods of increased movement. Furthermore, the opposite arm opening 670 in the embodiment of FIG. 20 helps to stabilize the arm warmer 610 on the body during the warm-up activities.

Embodiment with Pockets in Sleeve

Figure 21:
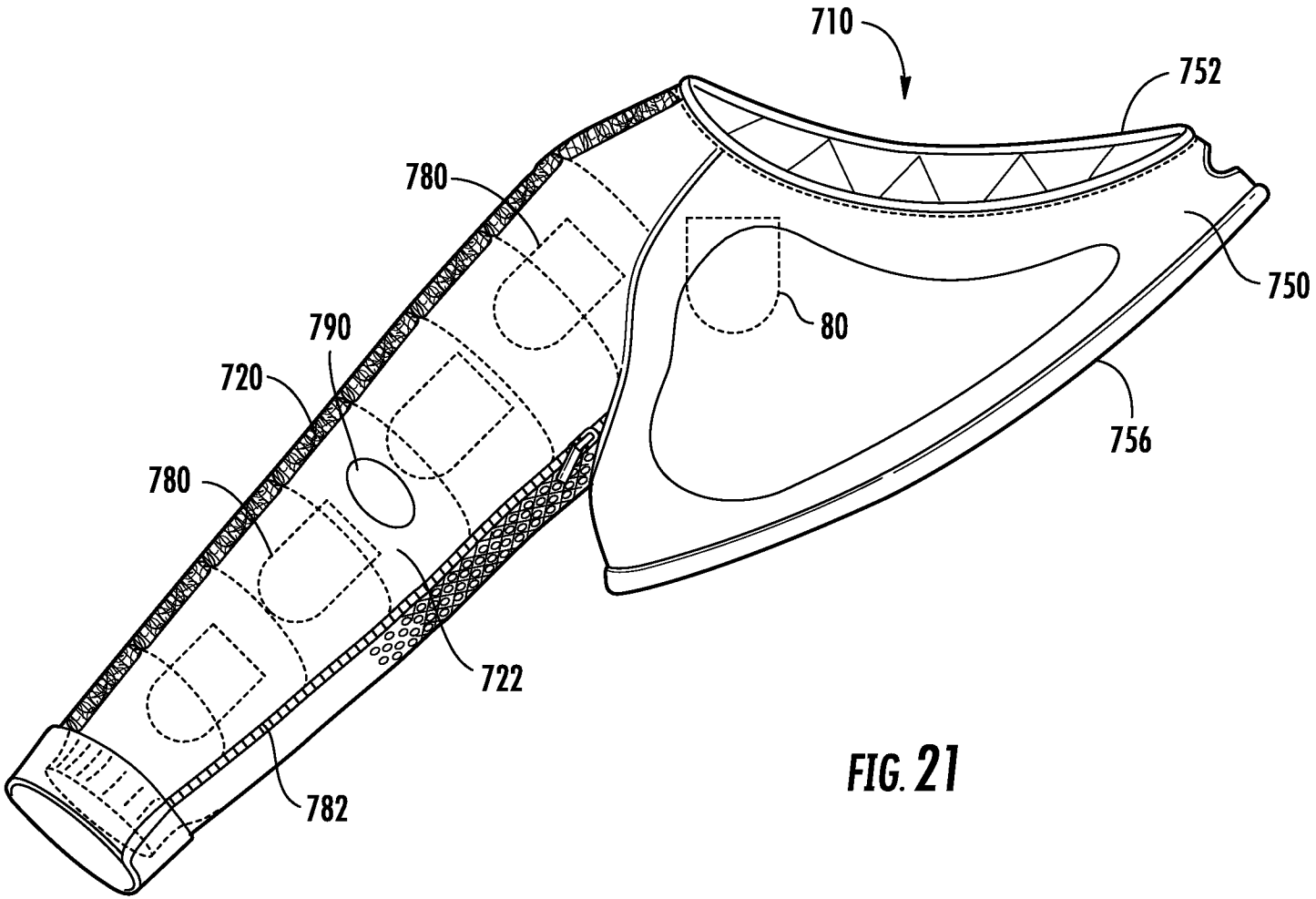
FIG. 21 shows a front view of another alternative embodiment of the arm warmer of FIG. 16.

With reference now to FIG. 21, yet another alternative embodiment of the arm warmer 710 is shown. In this embodiment, the arm warmer 710 includes pockets on the interior wall of the sleeve 722 and shoulder portion 740 (e.g., on layer 538 shown in FIG. 17). The pockets are configured to retain removable ice packs that may be used during post-game therapeutic applications. Exemplary locations for pockets on the sleeve 722 are represented by dotted lines 780 in FIG. 21. However numerous different configurations for the pockets 780 are possible.

In one embodiment, the pockets 780 are formed from a compression material, such as elastane. In this embodiment, the compression material is stretched to receive the ice packs, and then released to compress against the ice packs and hold the ice packs in place on the sleeve 722. In order to facilitate access to the pockets 780, the device 710 may include a zipper 782 that extends in a longitudinal direction along the sleeve 722. When un-zipped, the zipper 782 creates an opening in the sleeve 722 that provides access to the pockets 780 on the interior of the sleeve 722.

With continued reference to FIG. 21, in at least one embodiment, a temperature or time activated gauge is incorporated into the device 710 to notify the athlete when the arm has been iced for an appropriate amount of time and/or at an appropriate temperature. For example, the gauge may take the form of a patch 790 on the outside of the sleeve that changes color when the arm has been iced for an appropriate amount of time or the sleeve is at a predetermined temperature.

Alternative Vented Sleeve Arrangement

Figure 22:
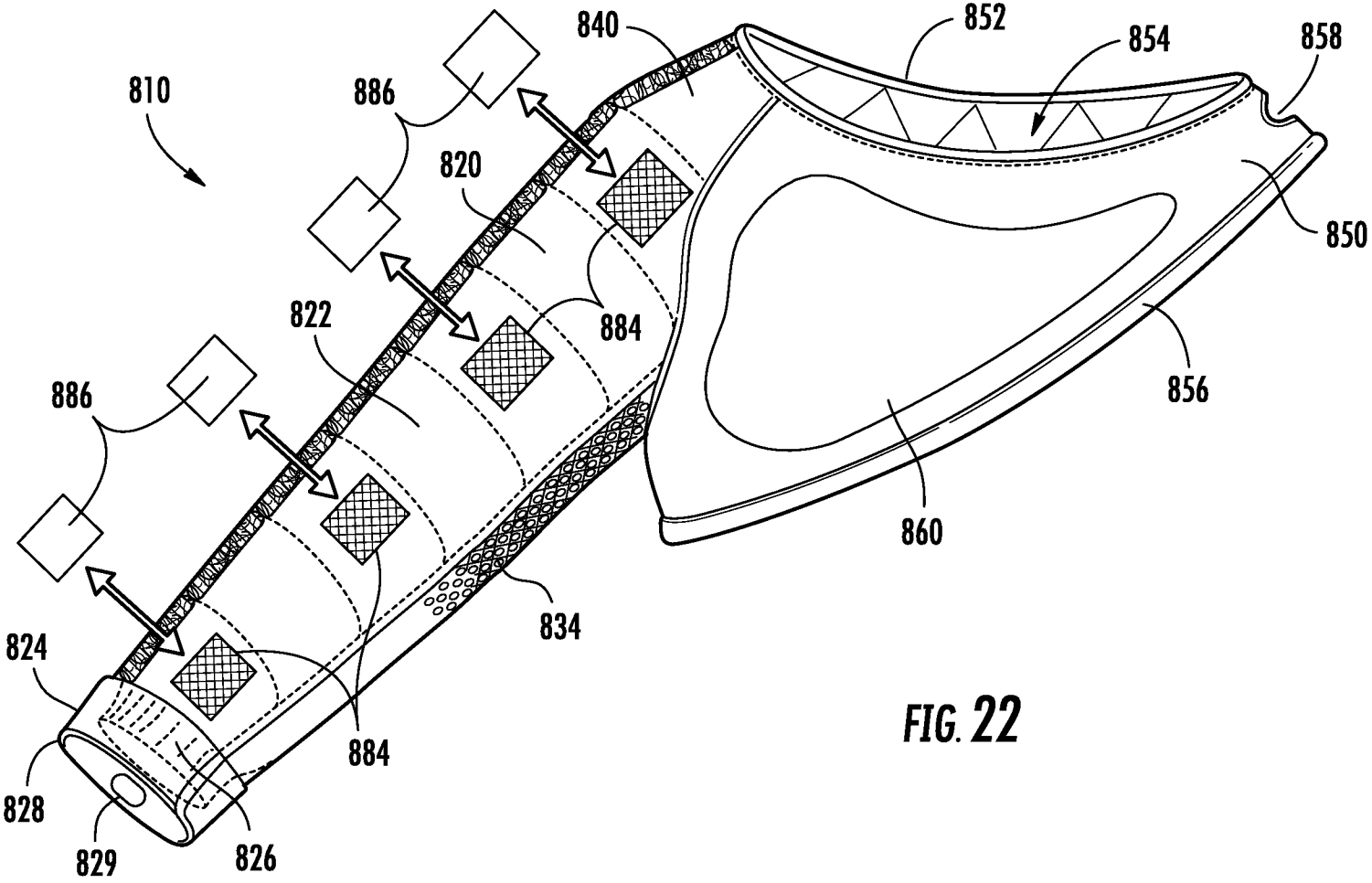
FIG. 22 shows a front view of yet another alternative embodiment of the arm warmer of FIG. 16.

With reference now to FIG. 22, an alternative embodiment of the vented sleeve arrangement for the arm warming device is shown. In the embodiment of FIG. 22, the sleeve 822 includes a plurality of vents 884 in addition to vent 834. The additional vents 884 may be provided on various positions on the sleeve 822, including the front, rear, upper and/or lower portions of the sleeve 822. For example, in the embodiment of FIG. 22, four additional vents 884 are on the front portion of the sleeve 822 and aligned from the lower to upper portions of the sleeve 822. The vents 884 are generally provided by a breathable fabric, such as a mesh material that allows heat to easily escape from the sleeve 822. Accordingly, the additional vents 884 are generally useful when the device 810 is used in warm or hot weather. However, in order to facilitate use of the device 810 in both warm and cold weather, each vent 884 may include an associated vent cover 886. The vent covers 886 are generally comprised of a fabric that is more insulating than the vent fabric, and acts to trap air within the sleeve 822. In at least one embodiment, the vent covers 886 may be releasably attached to the sleeve 822 using zippers, snaps, buttons, hook and loop fasteners, or other releasable fastening members. In such embodiment, the wearer can adjust the ventilation in the sleeve to a desired level, based on the outside temperature conditions. Although vent covers 86 have only been shown in FIG. 22 as covering vents 884, it will be recognized that a similar vent cover may be used to cover vent 834 on the under portion of the sleeve 822.

Embodiment with Weighted Portions

With reference now to FIGS. 23-29, an alternative embodiment of the arm warmer 210 is shown by arm warmer 910. In this embodiment, the arm warmer 910 is similar to the arm warmer 210 shown in FIGS. 5-8, but the arm warmer 910 in FIGS. 23-29 includes weights 980, such as weighted plate member 981 on the torso portion 950. Additionally, the arm portion 920 includes a multi-layered sleeve 922 with a single zipper 934 extending along the sleeve.

Figure 23:
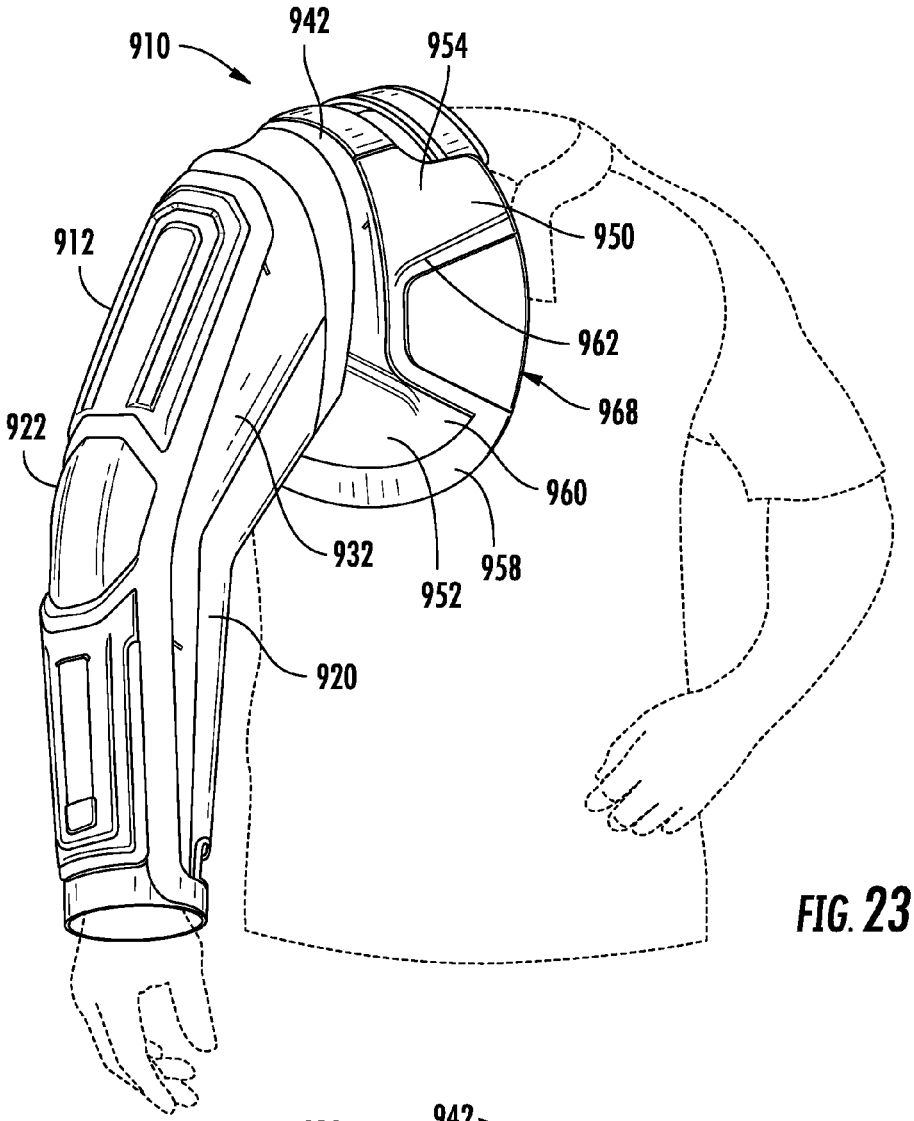
FIG. 23 shows a front perspective view of an alternative embodiment of the arm warmer of FIG. 5.

With particular reference to FIG. 23, the arm warmer 910 includes the single arm portion 920 and a torso portion 950 connected to the single arm portion. The single arm portion 920 is configured to substantially cover the first arm of the wearer from the shoulder to a position beyond an elbow of the first arm.

The torso portion 950 includes a shoulder portion 942 and a chest portion 960. The shoulder portion 942 is configured to substantially cover the shoulder of the wearer when the first arm of the wearer is positioned in the sleeve 922. The chest portion 960 includes a front part 962 that is configured to at least partially cover the chest of the wearer when the first arm of the wearer is positioned in the sleeve 922. In addition, the chest portion 960 also includes a back part 966 (see FIG. 29) that is configured to at least partially cover the upper back of the wearer when the first arm of the wearer is positioned in the sleeve 922.

The torso portion 950 is comprised of one or more materials that are capable of retaining heat and providing a warming effect to the athlete's shoulder and chest area. Accordingly, the torso portion 950 may be generally comprised of a fabric knit, woven, or non-woven construction, or a combination of such constructions. These fabrics may include any of various materials, such as polyester, cotton, elastane, or other fibers or combination thereof. In at least one embodiment, the torso portion 950 may include a two-layer construction where two different fabrics are combined to provide the desired effect. Additionally, the torso portion 950 may be comprised of other material such as a relatively rigid material or a foam material, similar to the materials disclosed in association with the previously described embodiments. In the embodiment shown in FIG. 23, the torso portion 950 is comprised of a fabric section 952, a molded foam section 954 a rubber EVA (ethylene-vinyl acetate) section 956, and a hard plastic ABS (acrylonitrile butadiene styrene) section 958.

Figure 24:
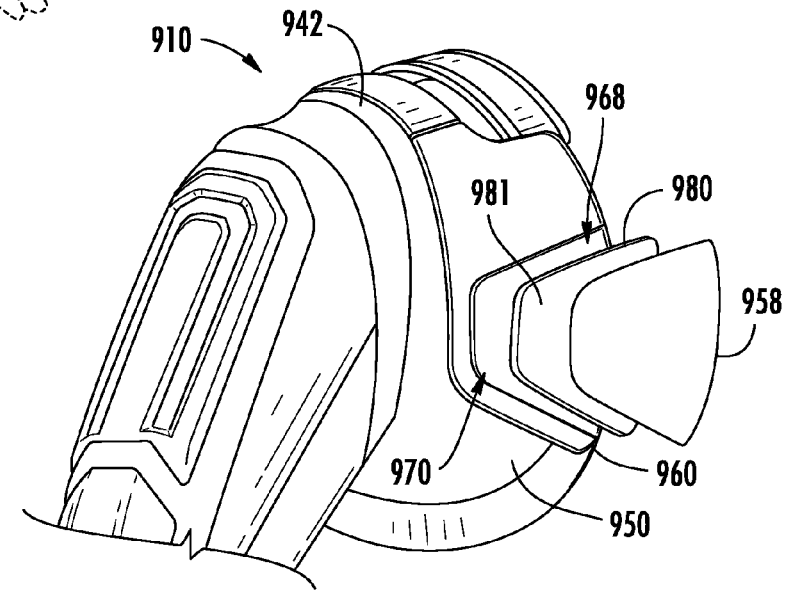
FIG. 24 shows an exploded view of a weight in a torso portion of the arm warmer of FIG. 23.

With reference now to FIG. 24, the chest portion 960 further includes a pocket 968 formed between the molded foam section 954 and the hard plastic ABS section 958. The pocket 968 is configured to retain a weight 980 on the chest portion 960. The pocket 968 is generally formed by a recess 970 in the molded foam section 954, with the hard plastic ABS section covering the recess 970. An opening to the pocket 968 may be provided along the front left side of the chest portion 960. The opening may be configured to allow the user to insert or remove the weight 980. Alternatively, the pocket 968 may be completely enclosed within the chest portion 960, preventing the user from inserting or removing the weight 980.

The weight 980 may be provided as a plate member 981, as shown in FIG. 24. Accordingly, the weight may be substantially flat with a perimeter that engages one or more edges in the recess 970 of the foam section 954. Alternatively, the weight may be provided in a different form, such as a plurality of cylinders or balls retained within the pocket. The weight 980 is positioned upon the chest portion 160, such that the weight 980 urges the chest portion 160 into engagement with the chest of the wearer. This helps retain the arm warmer 910 in proper position on the wearer, while also providing additional bulk and weight that may be comforting to the wearer.

While FIG. 24 shows only a weight 980 on the front 962 of the chest portion 960, it will be recognized that one or more additional weights 980 may be provided on other parts of the arm warmer 910, including other parts of the torso portion 950, or even other parts of the sleeve 922. For example, an additional weight may be provided in a back pocket positioned on the back 966 of the chest portion 960. This additional weight serves on the back 966 of the chest portion 960 urges the garment into engagement with the back of the wearer, and balances the weight of the arm warmer on the wearer.

The weight 980 has a density that is substantially greater than the density of the other materials that make up the torso portion 950 of the arm warmer 910. For example, in one embodiment, the weight may be at least 25% more dense than the other materials that make up the torso portion. Accordingly, the weight 980 weighs substantially more than the other materials that make up the torso portion on a unit volume basis.

The weight may be comprised of various relatively dense materials. In at least one embodiment, the weight is comprised of a metal material, such as iron or steel. In at least one embodiment, the weight 980 has a mass of at least three-hundred grams and less than one kilogram. For example, in at least one embodiment, the weight 980 has a mass of about three-hundred and fifty grams.

Figure 28:
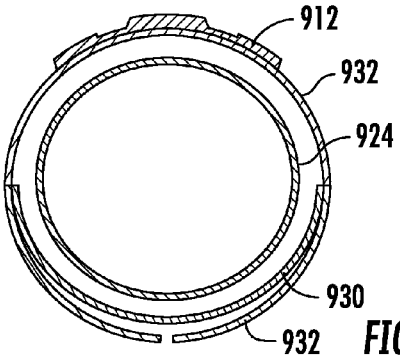
FIG. 28 shows a cross-sectional view of the sleeve of the arm warmer along line II-II of FIG. 26.
Figure 29:
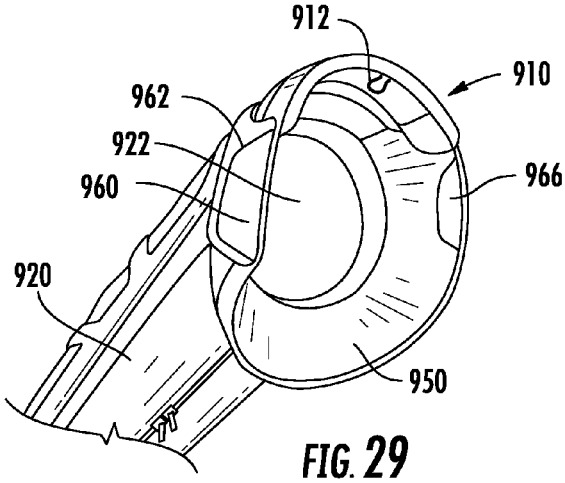
FIG. 29 shows a left side perspective view of the arm warmer of FIG. 23.
Figure 28A:
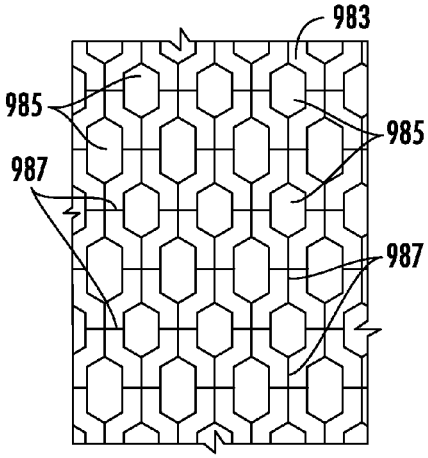

In at least one embodiment, the weights 980 are provided in the form of a flexible weighted sheet 983, as shown in FIG. 28A. The outer layer of the flexible weighted sheet 983 includes a plurality of bulbous portions 985 that encapsulate small weight members. Flexible interconnecting portions 987 extend between the bulbous portions 985. Accordingly, the flexible weighted sheet 983 may have the appearance of a bubble-wrap type structure including a flexible and relatively lightweight outer layer that encapsulates a plurality of small weight members at the bulbous portions 985. The outer layer may be comprised of a polymer material, such as TPU, or other appropriate material configured to retain the weighted members. The weight members may be metallic members of one or more different shapes and sizes. For example, the weight members may be barium spheres or cylinders. Accordingly, the flexible weighted sheet may be a barium infused TPU material. Alternatively, the weighted members may be any of various other materials of various sizes and shapes, as will be recognized by those of ordinary skill in the art, such that the weighted flexible sheet 983 is a weighted fabric, weighted TPU, or other weighted material.

In at least one embodiment, the flexible weighted sheet 983 may be provided in the pocket 968 on the torso portion, as shown in FIG. 24. Alternatively, the flexible weighted sheet 983 may be provided in any of various other locations on the arm warmer 910, including other parts of the torso portion 950 or the sleeve 922. For example, in at least one embodiment, the flexible weighted sheet 983 is connected to an inner layer 924 of the multi-layer sleeve 922, as shown in FIG. 28. The flexible weighted sheet 983 may be positioned at various locations throughout the sleeve 922, including the shoulder portion 942, the wrist end 928, or portions in-between. Additionally, the flexible weighted sheet 983 may extend along the entire circumference of the sleeve 922 or may only extend along a portion of the circumference of the sleeve. Moreover, it will be recognized that in other embodiments the flexible weighted sheet 983 may also be included on the torso portion 950, or may be included on the torso portion 950 in lieu of the sleeve 922.

With reference now to FIGS. 25A-29, the sleeve 922 is provided as a multi-layer member including an inner compression layer 924, an intermediate layer 930, an outer layer 932, and a plurality of reinforcement members 912 on the outer layer. As best shown in FIGS. 25B and 28, the inner compression layer 924 is substantially cylindrical in shape with a flared shoulder end 926 and a flared wrist end 928. The inner compression layer 924 may be comprised of any of various materials that have elasticity and are capable of providing compression to the arm of the wearer. Accordingly, the inner compression layer 924 may be comprised of a high-power compression knit fabric including elastane fibers. The inner compression layer 924 is attached to the outer layer 932 of the sleeve 922 at the flared shoulder end 926 and the flared wrist end 928. However, the inner compression layer 924 is substantially or completely free from connection to the other layers between the flared ends 926, 928. This allows the substantial length of the inner layer 924 to freely compress around a wearer's arm. The cylindrical construction of the inner compression layer 924 with the flared shoulder end 926 and flared wrist end 928, results in more compression provided to the elbow, forearm and bicep area of the wearer's arm, than the shoulder and wrist areas of the wearer's arm. As described above, and as illustrated in FIG. 28, the weighted flexible sheet 983 may be connected to an outer surface of the inner compression layer 924. The flexible weighted sheet provides the arm warmer 910 with a weighted substantial feel while also adding insulation to the sleeve 922.

Figure 25A:
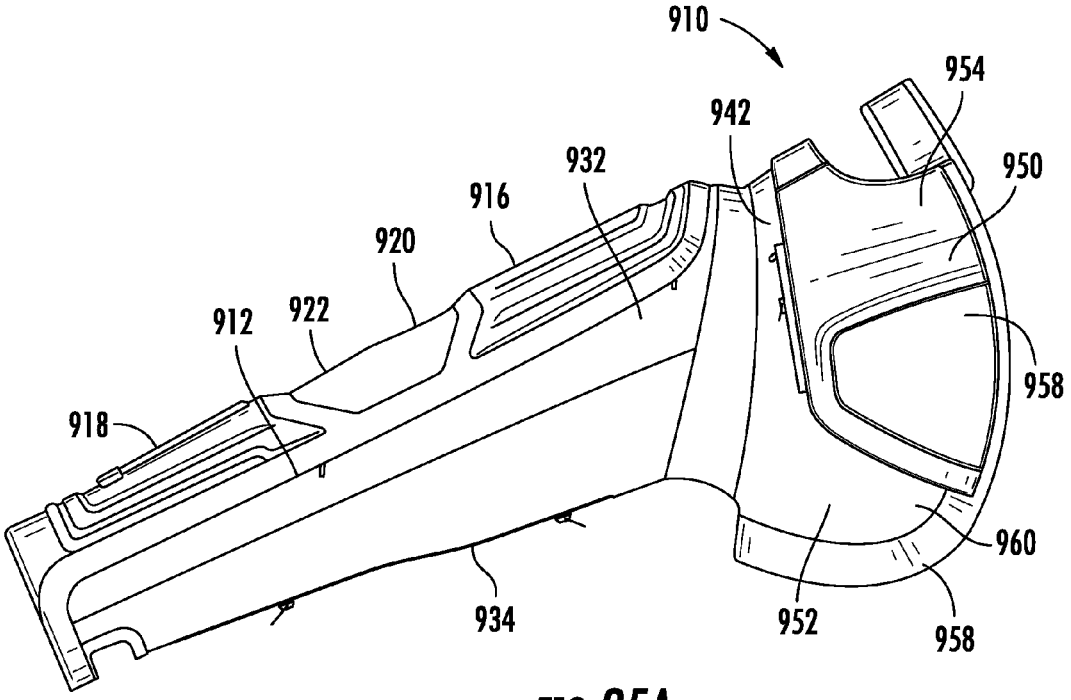
FIG. 25A shows a front view of the arm warmer of FIG. 23 a sleeve of the arm warmer in an extended position.
Figure 25B:
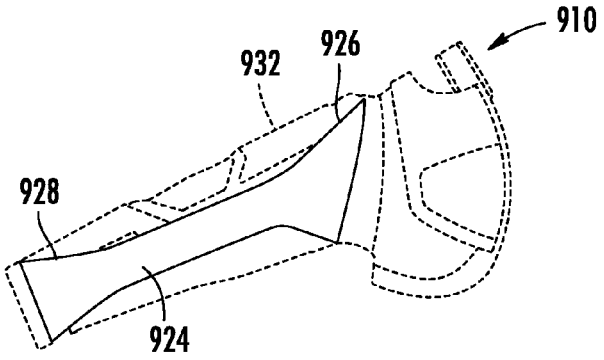
FIG. 25B shows an inner layer of the sleeve of FIG. 25A.
Figure 25C:
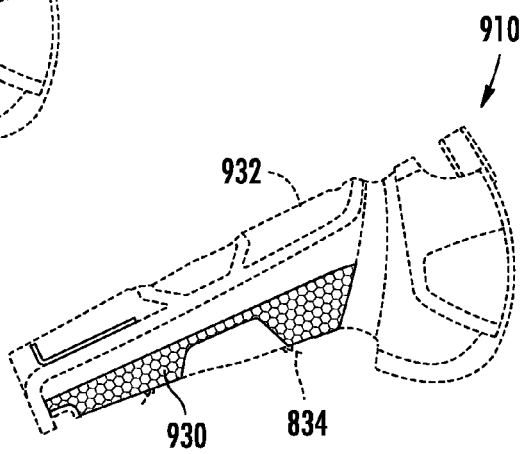
FIG. 25C shows an intermediate layer of the sleeve of FIG. 25A.

As best shown in FIGS. 25C and 28, the intermediate layer 930 is provided between the inner layer and outer layer 932 along a medial portion of the sleeve (i.e., a portion of the sleeve that is typically closer to the torso of the wearer when the wearer's arm extends downward). The intermediate layer 930 is connected to the outer layer along two lateral seams extending axially along the sleeve 922. The intermediate layer 930 is comprised of a mesh material that is highly permeable to air.

As best shown in FIGS. 25A and 28, the outer layer 932 of the sleeve 922 is substantially cylindrical. The outer layer 932 of the sleeve 922 is generally comprised of flexible fabric of a knit, woven, or non-woven construction, or a combination of such constructions. These fabrics may include any of various materials, such as polyester, cotton, elastane, or other fibers or combination thereof.

The arm warmer 910 in the embodiment of FIGS. 23-29 further includes a zipper arrangement 934 that provides for ventilation on the sleeve 922. As best shown in FIGS. 25A and 28, the zipper arrangement 934 may be adjusted to expose the intermediate layer 930 comprised of mesh material. This allows the user to selectively determine the amount of ventilation to be provided to the inner layer 924 and the associated arm of the wearer.

Figure 26:
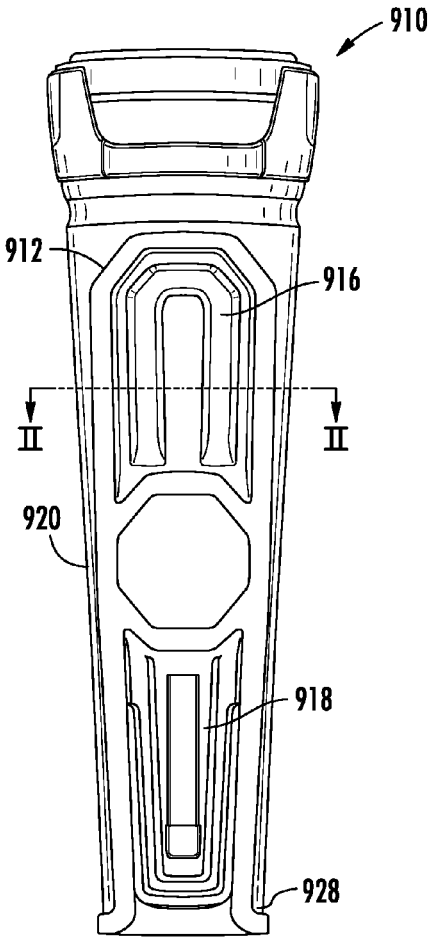
FIG. 26 shows a top view of the arm warmer of FIG. 25A.
Figure 27:
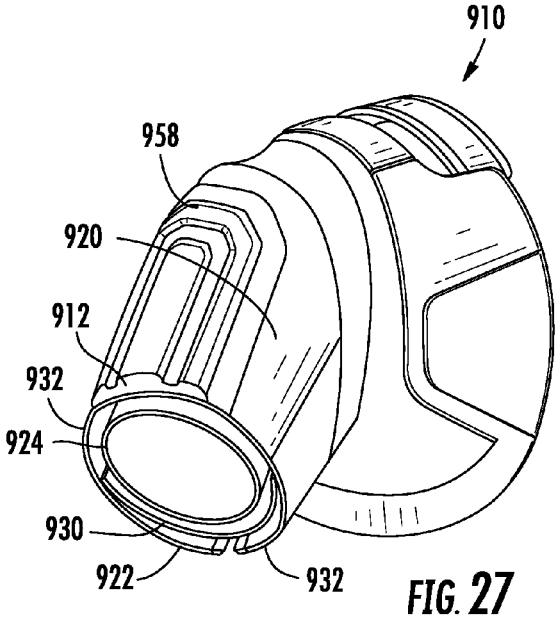
FIG. 27 shows a cutaway view of the sleeve of the arm warmer along line II-II of FIG. 26.

As best shown in FIGS. 25A and 26, the plurality of reinforcement members 912 are provided on the outer layer 932 of the sleeve 922. These reinforcement members 912 include an upper arm support 916 and a forearm support 918. The various reinforcement members 912 provide additional rigidity to the sleeve 922 while still allowing for user mobility. The reinforcement members 912 are generally comprised of a relatively heavy material that adds weight to the sleeve 922 and stabilizes the sleeve by providing a shell-like effect on the outer surface of the sleeve 922. In at least one embodiment, the reinforcement members 912 may be comprised of heavy duty ballistic nylon or similar material. In another exemplary embodiment, the reinforcement members may be comprised of a natural or synthetic rubber material, ethylene-vinyl acetate (EVA) or thermoplastic polyurethanes (TPU). The reinforcement members 912 may be formed by any of various processes such as compression molding.

Embodiment with Extendable Glove

In at least one embodiment the arm warmer 910 described with reference to FIGS. 23-29 further includes a hand covering. For example, in the embodiment shown in FIGS. 30-32, the arm warmer 910 includes a hand covering in the form of a mitt 990 that is moveably coupled to the wrist end of the sleeve 922 by a tether 992.

The mitt 990 is generally comprised of a fabric material that is flexible and capable of providing insulation around the fingers and hand of a user, allowing the user to warm his or her hand. Accordingly, the mitt 990 may be comprised of a knit or woven fabric formed from cotton, wool, polyester, or other fibers. The mitt 990 is generally provided as a bag-like structure that is closed at a distal end and open at a proximal end. The mitt 990 is configured to receive the user's fingers and a portion of the palm and opisthenar (i.e., the back of the hand) at the proximal end of the mitt. In the disclosed embodiment, the mitt 990 does not include a thumb. Thus, the wearer may choose to place his or her thumb outside of the mitt 990 when the fingers are inserted into the mitt 990, or the user may choose to place his or her thumb into the mitt 990 along with the other fingers.

Figure 30:
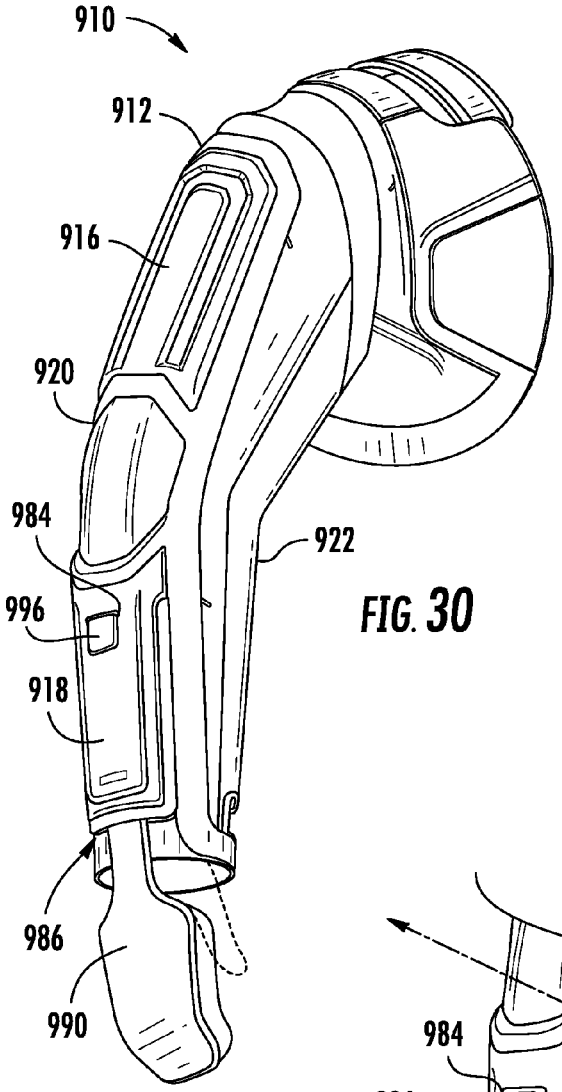
FIG. 30 shows a front perspective view of an alternative embodiment of the arm warmer of FIG. 23 including a retractable hand warmer mitt extending from the sleeve.
Figure 32:
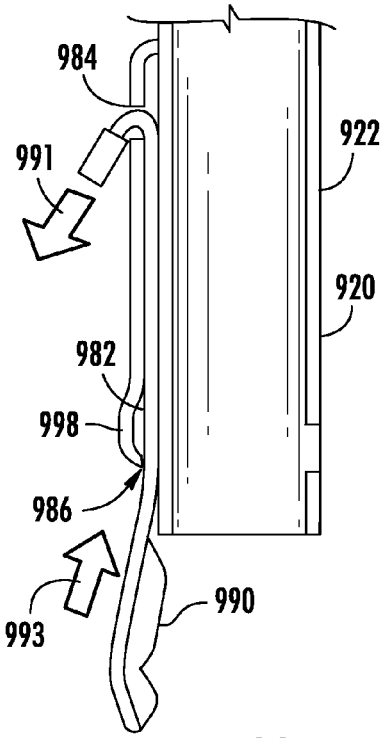
FIG. 32 is a cross-sectional view of the arm warmer along a plane extending through lines 31A and 31B of FIG. 31, illustrating retraction of the hand warmer mitt into the sleeve.
Figure 31:
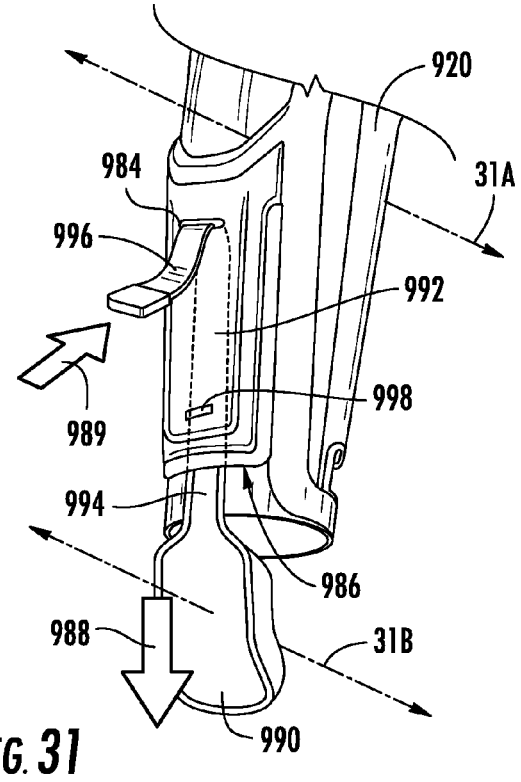
FIG. 31 shows a front perspective view of the arm warmer of FIG. 30 illustrating extension of the hand warmer mitt from the sleeve.

As shown in FIGS. 30-32, the tether 992 is connected to the mitt 990. In the disclosed embodiment, the tether 992 is a thin strap member having a first end 994 and a second end 996. The first end 994 of the tether is connected to the proximal end of the mitt 990. The tether 992 extends from the mitt 990 and through a pocket 982 formed on the outer layer 932 of the sleeve 922. The tether 992 enters the pocket 982 at a distal opening 986 to the pocket 982 that is arranged and dimensioned to receive the mitt 990. The tether 992 exits the pocket 982 through a slot 984 on a proximal end of the pocket 982. The second end 996 of the tether is releasably coupled to a coupling component 998 provided on the outside of the pocket 982. The second end 996 of the tether 992 includes a coupling component that is complimentary to the coupling component 998 on the outside of the sleeve 922. For example, the coupling component 998 may be a magnet, and a complimentary magnet may be provided on the second end 996 of the tether 992. As another example, the coupling component may be a loop portion of a hook-and-loop arrangement, and the second end 996 of the tether 992 may include a hook portion of the hook-and-loop arrangement. The second end of the tether 992 is enlarged relative to rest of the tether. Accordingly, the second end 996 of the tether 992 may be flared or include a tab that will not fit through the slot 984. This prevents the tether 992 from being released from the arm portion 920.

With reference to FIG. 31, when the wearer wishes to use the mitt 990, the user releases the second end 996 of the tether 992 from the coupling component 998, and pulls the mitt 990 through the opening 986 and out of the pocket 982 in the direction of arrow 988. As the mitt 990 is pulled out of the pocket 982, the tether 992 is pulled through the slot 984 as indicated by arrow 989. Because the second end 996 of the tether 992 is enlarged, the second end 996 will not pass through the slot 984, and this limits the distance the mitt 990 may be pulled away from the pocket 982 and the wrist end of the sleeve 922. When the mitt 990 is moved to this extended position away from the wrist end of the sleeve 922, the user may easily insert his or her hand into the mitt 990.

With reference now to FIG. 32, when the wearer wishes to return the mitt 990 to the pocket 982, the user simply pulls the second end 996 of the tether 992 away from the slot 984, as indicated by arrow 991. As the second end 996 of the tether 992 is pulled away from the slot 984, the tether 992 slides through the slot 984 and pocket 982, causing the first end 994 of the tether to pull the mitt 990 in the direction of arrow 993 and into the pocket 982. Once the mitt 990 is moved to this retracted position with the mitt 990 within the pocket 982, the user may couple the second end 996 of the tether 992 to the coupling component 998 to secure the tether 992 in place on the sleeve 922, and prevent the tether from flipping around during movement of the arm portion 920.

While one embodiment of the arm warmer 910 with hand covering has been described above, it will be recognized that various alternative embodiments are possible. For example, in at least one embodiment, the mitt 990 may be pulled to the retracted position where it engages the sleeve by pulling the mitt through the cuff at the wrist end of the sleeve. In this embodiment, the mitt 990 may be loosely retained within the sleeve 922 or pulled into a pocket on the interior of the sleeve. As another example of an alternative embodiment, while the hand covering has been described as a mitt 990 with no thumb in the embodiment of FIGS. 30-32, it will be recognized that the hand covering may be provided in any of various other forms, such as a mitt with a thumb, a glove with complete fingers, a glove with partial fingers, or any of various other forms as will be recognized by those of ordinary skill in the art.

Various Other Embodiments

Although various embodiments of the arm warmer are described above with reference to FIGS. 1-32, it will be recognized that numerous other embodiments are possible. For example, in another embodiment of the arm warmer, the device is configured for use on either the left arm or the right arm of the wearer. In this embodiment, the arm warmer may be reversible, such that it is configured to cover the right arm of the wearer when worn in one orientation and is configured to cover the left arm when turned inside-out and worn in the reverse orientation. Alternatively, the arm warmer may simply be substantially symmetric about a central plane, such that the arm warmer may be worn in one orientation to cover the right arm or rotated 180° to cover the left arm.

In at least one alternative embodiment, the arm may comprise an articulated sleeve, resulting in a bent or angled sleeve that is not substantially straight. For example, an articulated sleeve may be formed by incorporating a seam in the elbow area that provides an angled elbow portion. The angle at the elbow portion could be any of various angles to encourage the wearer to retain his or her arm in a certain position, reduce resistance and/or promote comfort. For example, the sleeve may be articulated to encourage the wearer to bend his or her arm as if it were in a sling (e.g., an articulated sleeve with a bend of about 60° to 90° may be used to accomplish this). Various articulation levels may be offered on different warmer devices, thus allowing the wearer to purchase a warmer device with a desired level of articulation.

Although the present invention has been described with respect to certain preferred embodiments, it will be appreciated by those of skill in the art that other implementations and adaptations are possible. For example, although the arm warmer disclosed herein has been described in association with the sport of baseball, the described embodiments or other embodiments could be used in association with other sports. As another example, although the arm warmer has been generally described above as a one-piece device, it could also be configured as one interchangeable piece with removable parts. Moreover, there are advantages to individual advancements described herein that may be obtained without incorporating other aspects described above. Additionally, there may be advantages to combining features from various disclosed embodiments, as may be recognized by those of ordinary skill in the art. Therefore, the spirit and scope of any appended claims should not be limited to the description of the preferred embodiments contained herein.

What is claimed is:

1. A device for warming a first arm and a shoulder of a wearer, the device comprising:

a single arm portion configured to substantially cover the first arm of the wearer from the shoulder to a position beyond an elbow of the first arm;

a torso portion including a shoulder portion and a chest portion, the torso portion connected to the single arm portion, the torso portion including at least one pocket provided in a foam section of the chest portion and a hard plastic section covering the pocket; and at least one weight retained in the pocket of the torso portion.

2. The device of claim 1 wherein the torso portion and single arm are substantially comprised of a first material, and wherein the at least one weight has a density that is substantially greater than the density of the first material.

3. The device of claim 1 wherein the chest portion includes a front chest portion and a back chest portion, wherein the at least one pocket includes a front pocket in the front chest portion and a back pocket in the back chest portion, the front pocket separate from the back pocket, and wherein the at least one weight includes a front weight in the front pocket and a back weight in the back pocket.

4. The device of claim 1 wherein the at least one weight is a plate member.

5. The device of claim 4 wherein the plate member is a metal plate.

6. The device of claim 1 wherein the at least one weight has a mass of at least 300 grams.

7. The device of claim 6 wherein the at least one weight has a mass of less than one kilogram.

8. A garment for warming a first arm and shoulder of a wearer, the garment comprising:

a sleeve configured to receive the first arm of the wearer and substantially cover the first arm of the wearer, the garment not including an opposing sleeve configured to receive a second arm of the wearer;

a torso portion connected to the sleeve, the torso portion including a shoulder portion and a chest portion, the chest portion including a cushion section and a protective member, the shoulder portion configured to at least partially cover the shoulder of the wearer when the first arm of the wearer is received by the sleeve; and at least one weight retained on the garment, the at least one weight arranged on the garment to urge the garment to engage the wearer when the first arm of the wearer is received by the sleeve, wherein the at least one weight is a weight plate retained in at least one pocket on the chest portion, the at least one pocket provided in the cushion section of the torso portion with the protective member covering the pocket, and wherein the weight plate is arranged on the chest portion to urge the chest portion to engage a chest of the wearer when the first arm of the wearer is received by the sleeve.

9. The garment of claim 8 wherein the at least one pocket includes a front pocket in a front chest portion and a back pocket in a back chest portion, the front pocket separate from the back pocket.

10. The garment of claim 8 wherein the at least one weight includes a flexible weighted sheet.

11. The garment of claim 10 wherein the sleeve is a multi-layered sleeve and the flexible weighted sheet is retained on an inner surface of the multi-layered sleeve.

12. The device of claim 10 wherein the flexible weighted sheet includes a plurality of bulbous portions that encapsulate weight members.

13. The garment of claim 8 wherein the torso portion and sleeve are comprised of a first material, and wherein the at least one weight has a density that is substantially greater than the density of the first material.

14. The garment of claim 8 further comprising a glove coupled to a wrist end of the sleeve, the glove moveable on the sleeve between a retracted position wherein the glove is inserted into an opening on the sleeve and an extended position wherein the glove extends past the wrist end of the sleeve.

15. The garment of claim 8 wherein the cushion section is a foam section and the protective member is a hard plastic member.

* * * * *